US007084717B2

(12) United States Patent
Okazaki et al.

(10) Patent No.: US 7,084,717 B2
(45) Date of Patent: Aug. 1, 2006

(54) QUADRATURE HYBRID CIRCUIT

(75) Inventors: Hiroshi Okazaki, Yokosuka (JP); Tetsuo Hirota, Ishikawa-gun (JP); Atsushi Fukuda, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 10/936,692

(22) Filed: Sep. 9, 2004

(65) Prior Publication Data

US 2005/0052259 A1 Mar. 10, 2005

(30) Foreign Application Priority Data

Sep. 9, 2003 (JP) ..... 2003-317132

(51) Int. Cl.
*H01P 1/10* (2006.01)

(52) U.S. Cl. ..... 333/118; 333/117; 333/101

(58) Field of Classification Search ..... 333/101, 333/103, 109, 117, 118
See application file for complete search history.

(56) References Cited

U.S. PATENT DOCUMENTS 3,659,227 A 4/1972 Whistler
6,667,670 B1 12/2003 Hong et al. ..... 333/101

FOREIGN PATENT DOCUMENTS

JP 60-52101 3/1985
JP 4-219001 8/1992

OTHER PUBLICATIONS

Ryszard W. Vogel, "Analysis and Design of Lumped-and Lumped-Distributed-Element Directional Couplers for MIC and MMIC Applications", IEEE Transactions on Microwave Theory and Techiniques, vol. 40, No. 2, XP-002300583, Feb., 1992, pp. 253-262.
J.Reed, et al., "A Method of Analysis of Symmetrical Four-Port Networks", IRE Transactions on Microwave Theory and Techniques, vol. MTT-4, 1956 pp. 246-252.
I.D. Roberstson ed., "Special MMIC realisations", MMIC Design, IEE, 1995, 2 pages.
Tetsuo Hirota, et al., "Reduced-Size Branch-Line and Rat-Race Hybrids for Uniplanar MMIC's", IEEE Transactions on Microwave Theory and Techniques, vol. 38, No. 3, Mar. 1990, pp. 270-275.

*Primary Examiner*—Dean Takaoka
(74) *Attorney, Agent, or Firm*—Oblon, Spivak, McClelland, Maier & Neustadt, P.C.

(57) ABSTRACT

In a quadrature hybrid circuit which has first and second two-port circuits 11 and 12 inserted between I/O ports P1 and P2 and between I/O ports P4 and P3, respectively, and third and fourth two-port circuits inserted between I/O ports P1 and P4 and between I/O ports P2 and P3, respectively, and which is configured so that under the condition that the I/O ports P1 to P4 are matched, a high-frequency signal fed via the I/O port P1 is divided between the I/O ports P2 and P3 and the divided two signals are output 90° out of phase with each other but no signal is provided to the I/O ports P4, there are provided SPST switches 7 and 8 responsive to external control to control electromagnetic connections or coupling across a plane of symmetry 5 of the quadrature hybrid circuit passing through intermediate points of symmetry 23 and 24 of the third and fourth two-port circuits 21 and 22.

13 Claims, 14 Drawing Sheets

QUADRATURE HYBRID CIRCUIT

TECHNICAL FIELD

The present invention relates to a quadrature hybrid circuit that is used as a power divider or power combiner for high-frequency signals in the radio frequency band.

BACKGROUND ART

A quadrature hybrid circuit is now in widespread use as a power divider/combiner for dividing/combining high-frequency signals in the radio frequency band (J. Reed and G. J. Wheeler, "A Method of Analysis of Symmetrical Four-Port Networks," IRE Trans. Microwave Theory Tech., vol. MTT-4, pp. 246–253, 1956). FIG. 25 shows a branch-line hybrid circuit that is an example of the conventional quadrature hybrid circuit. Reference characters P1 to P4 denote I/O ports (hereinafter also referred to simply as ports). A transmission line 11, which is a two-port circuit between the ports P1 and P2, has a characteristic impedance $Z=(Z_0/\sqrt{2})$ and an approximately quarter-wave electrical length $\theta(\theta=\lambda_0/4)$ at a predetermined frequency $f_0$ (wavelength $\lambda_0$). Similarly, a transmission line 12, which is a two-port circuit between the ports P4 and P3, has a characteristic impedance $Z=(Z_0/\sqrt{2})$ and an approximately quarter-wave electrical length $\theta(\theta=\lambda_0/4)$ at the frequency $f_0$ (wavelength $\lambda_0$). A transmission line 21, which is a two-port circuit between the ports P1 and P4, has a characteristic impedance $Z=Z_0$ and an approximately quarter-wave electrical length $\theta(\theta=\lambda_0/4)$ at the frequency $f_0$ (wavelength $\lambda_0$). Similarly, a transmission line 22, which is a two-port circuit between the ports P2 and P3, has a characteristic impedance $Z=Z_0$ and an approximately quarter-wave electrical length $\theta(\theta=\lambda_0/4)$ at the frequency $f_0$ (wavelength $\lambda_0$).

With such a circuit arrangement as described above, a quadrature hybrid circuit is formed which operates with a coupling of 3 dB for high-frequency signals in the vicinity of the frequency $f_0$. Where a matched load (an impedance $Z_0$) is connected to each of the ports P2, P3 and P4 of the quadrature hybrid circuit, the power of a high-frequency signal fed via the port P1 under the matched condition divides evenly between the ports P2 and P3 and none is provided to the port P4. In this case, the high-frequency signals provided to the ports P2 and P3 are phased 90° apart. Thus the quadrature hybrid circuit can be used as a power divider for high-frequency signals.

The coupling of the quadrature hybrid circuit depends on the characteristic impedance Z of the above-mentioned quarter-wave transmission line. For the sake of brevity, the characteristic impedance Z is expressed below by admittance Y (where Y=1/Z). Letting the characteristic admittances of the transmission lines 11 and 12 be represented by $Y_1$ and the characteristic admittances of the transmission lines 21 and 22 by $Y_2$, the coupling, C[dB], of the quadrature hybrid circuit is $$C=20\times\log(Y_1/Y_2) \quad \text{(i)}$$

To match input and output terminals, letting the admittance of the load be represented by $Y_0=1/Z_0$, it is necessary that $$Y_0^2=Y_1^2-Y_2^2 \quad \text{(ii)}$$

that is, $$Y_1=(Y_0\times Y_0+Y_2\times Y_2)^{1/2} \quad \text{(iii)}$$

Accordingly, where a matched load is connected to each of the I/O ports P2, P3 and P4, the power of the high-frequency signal input via the I/O port P1 under the matched condition is provided to the I/O port P3 at a value reduced by C[dB] and the remaining power is fed to the I/O port P2. With the coupling set at 3 dB, $Y_1=\sqrt{2}\times Y_0$ and $Y_2=Y_0$; in terms of characteristic impedance, $Z_1=1/Y_1=(Z_0/\sqrt{2})$ and $Z_2=1/Y_2=Z_0$, which are the characteristic impedances of respective transmission lines of the 3 dB quadrature hybrid circuit.

The quadrature hybrid circuit has two planes of symmetry, with respect to which the I/O ports P1, P2, P3 and P4 are symmetrical to each other. These planes of symmetry are denoted by 5 and 6 in FIG. 25. The planes of symmetry 5 and 6 are normal to the plane of the paper. By virtue of this symmetry, the power of a high-frequency signal input via the I/O port P2 to the above-mentioned 3 dB quadrature hybrid circuit under the matched condition divides equally but 90° out of phase between the I/O ports P1 and P4, and no power is provided to the I/O port P3. The power of a high-frequency signal input via the I/O port P3 under the matched condition divided equally but 90° out of phase between the I/O ports P4 and P1, and no power is fed to the I/O port P2. Similarly, the power of a high-frequency signal input via the I/O port P4 under the matched condition divided equally but 90° out of phase between the I/O ports P3 and P2, and no power is fed to the I/O port P1.

It can be seen from the above that the quadrature hybrid circuit is a reversible circuit because of its characteristics mentioned above. That is, the high-frequency signal fed via the I/O port P1 into the 3 dB hybrid circuit is provided to the I/O ports P2 and P3 and no signal is output to the I/O port P4, whereas when high-frequency signals of the frequency $f_0$ and of the same power but phased 90° apart are simultaneously input via the I/O ports P2 and P3, they are combined together and provided to the I/O port P1 and no output is provided to the I/O port P4, either. Accordingly, the quadrature hybrid circuit can be used for power combination of high-frequency signals. By inverting the phase difference between the input signals to the I/O ports P2 and P3 from 90° to −90°, the I/O port to which the output signal is provided can also be changed from P1 to P4.

With a view to miniaturizing power dividers and power combiners, there is also used a lumped branch-line hybrid circuit that employs, as a substitute for the quarter-wave transmission line used in the branch-line hybrid circuit, a π-circuit composed of an inductor and a capacitor that are lumped elements and equivalent to the quarter wave transmission line at at least a desired frequency (I. D. Robertson ed., "MMIC DESIGN," p. 84–85, IEE, London, 1995). By determining the characteristic admittances $Y_1$ and $Y_2$ such that the desired coupling may be obtained with Eqs. (i) and (ii) and by selecting the value of each circuit element such that the circuit formed by lumped elements may become equivalent to the quarter-wave line of the characteristic admittance $Y_1$ or $Y_2$ at the desired frequency $f_0$, it is possible to implement a lumped quadrature hybrid circuit of a desired coupling.

FIG. 26 depicts an example of such a hybrid circuit, in which two-port circuits 31 and 32 are connected between the ports P1 and P2 and between the ports P3 and P4, respectively, and two-port circuits 33 and 34 are connected between the ports P1 and P4 and between the ports P2 and P3, respectively. The two-port circuits 31 to 34 are each formed by a π-circuit composed of an inductor connected between the two ports and capacitors connected to between one and the other ends of the inductor and the ground, respectively. More specifically, by setting the inductances of inductors 101 and 104 forming the two-port circuits 31 and 32 at $(Z_0/\sqrt{2})/2\pi f_0$ and the capacitances of capacitors 102, 103, 105 and 106 at $1/(2\pi f_0 \times (Z_0/\sqrt{2}))$, the characteristic impedance $Z_1$ of each of the two-port circuits 31 and 32 each formed by the π-circuit is $Z_0/\sqrt{2}$ and its electrical length θ becomes equivalent to an approximately quarter-wave (where $\theta=\lambda_0/4$) transmission line at the frequency $f_0$.

Similarly, by setting the inductances of the inductors 107 and 110 at $Z_0/2\pi f_0$ and the capacitances of capacitors 108, 109, 111 and 112 at $1/(2\pi f_0 \times Z_0)$, the characteristic impedance $Z_2$ of each of the two-port circuits 33 and 34 is $Z_0$ and its electrical length θ becomes equivalent to the approximately quarter-wave (where $\theta=\lambda_0/4$) transmission line at the frequency $f_0$. Accordingly, a 3 dB quadrature hybrid circuit that uses, as a substitute for each quarter-wave line, the π-circuit that exhibits characteristics equivalent to those of the quarter-wave line at the desired frequency $f_0$ can be formed by lumped elements as shown in FIG. 26.

There is also proposed a quasi-lumped branch-line hybrid circuit of the type that uses, as a substitute for the quarter-wave transmission line, a π-circuit similarly formed by a combination of a transmission line and a lumped element (T. Hirota, et al., "Reduced-Size Branch-Line and Rat-Race Hybrids for Uniplanar MMIC's," IEEE Trans. Microwave Theory and Tech., vol. MTT-38, pp. 270–275, 1990).

The above-described power divider and power combiner are used, for example, in a parallel operation power amplifier composed of two power amplifiers. This power amplifier may sometimes be controlled to stop power supply to one of the two amplifiers to temporarily withhold parallel operation for the purpose of reducing power consumption when the output power is expected to be low. A prior art example of such a parallel operation amplifier will be described below with reference to FIG. 27. Reference numerals 41 and 42 denote power amplifiers, which constitute the parallel operation power amplifier. Reference numerals 43 and 44 denote transmission lines, and 45 and 46 denote conventional quadrature hybrid circuits.

P1 to P4 of each of the quadrature hybrid circuits 45 and 46 indicate port numbers, which correspond to the I/O ports P1 to P4 in FIG. 25, respectively. Reference numerals 47, 48, 49 and 50 denote SPDT (Single Pole Double-Throw) switches; 51 and 52 denote matching resistors (resistance $Z_0$); 63 denotes a signal input terminal; and 64 denotes a signal output terminal. The power amplifiers 41 and 42 are equivalent in their characteristics, and the quadrature hybrid circuits 45 and 46 have their coupling set at 3 dB. With the two SPDT switches and one transmission line added to the conventional quadrature hybrid circuit, there are formed, as indicated by the broken lines 61 and 62, first and second switching parts for ON/OFF control of the power dividing or combining operation of the parallel operation power amplifier.

With the power amplifiers 41 and 42 held ON and the SPDT switches 47 to 50 connected to the ports of the quadrature hybrid circuits 45 and 46 as depicted in FIG. 27, a high-frequency signal of frequency $f_0$ fed via the signal input terminal 63 is divided by the first quadrature hybrid circuit 45 into two, which are amplified by the power amplifiers 41 and 42 and combined together by the second quadrature hybrid circuit 46, thereafter being output via the signal output terminal 64.

On the other hand, when the power amplifier 41 is held ON and the SPDT switches 47 to 50 are connected to the transmission lines 43 and 44, the high-frequency signal of frequency $f_0$ input via the signal input terminal 63 passes through the transmission line 43 and is applied only to and amplified by the power amplifier 41, thereafter being provided via the transmission line 44 to the signal output terminal 64. By cutting off the power supply to the power amplifier 42 in this case, its power consumption can be reduced.

In the prior art example of FIG. 27, the switching parts indicated by the broken lines 61 and 62 implement ON/OFF control of the power dividing or combining operation of the quadrature hybrid circuit by adding two SPDT switches and one transmission line to the conventional circuit structure as referred to above. For similar ON/OFF control of the power dividing or combining operation for the input to the I/O port of the quadrature hybrid circuit shown in FIG. 25, too, four SPDT switches and two transmission lines need to be added to the conventional quadrature hybrid circuit structure as depicted in FIG. 28. Accordingly, the prior art presents the disadvantage of increased circuit complexity and bulkiness when it is necessary to perform the ON/OFF control of the power dividing or combining operation. Besides, where each SPDT switch is formed by a semiconductor switch, two SPST (Single Pole Single-Throw) switches SW1 and SW2 are used which are controlled by a control unit 56 to turn ON and OFF in reverse relative to each other as shown in FIG. 29; therefore, as compared with the case of using one SPST switch that simply connects or disconnects two terminals, the number of circuit components used is large, their control is complex, and performance decreases.

SUMMARY OF THE INVENTION

It is therefore an object of the present invention to provide a simple-structured quadrature hybrid circuit capable of ON/OFF control of the power dividing or combining operation with a small number of circuit components.

According to the present invention, in a quadrature hybrid circuit in which, under the condition that first, second, third and fourth I/O ports are all matched, a high-frequency signal fed via the first I/O port is divided according to a predetermined coupling and the divided signals are provided to the second and third I/O ports in phases displaced 90° apart, there is provided:

circuit element means by which boundary condition on a plane of symmetry, with which side of the first and second I/O ports and side of the fourth and third I/O ports of the quadrature hybrid circuit are symmetrical to each other, is controlled in response to an external control signal so that said plane of symmetry become equivalent to a magnetic wall or electric wall.

DETAILED DESCRIPTION OF THE PREFERRED EMBODIMENTS

Embodiment 1

Figure 1:
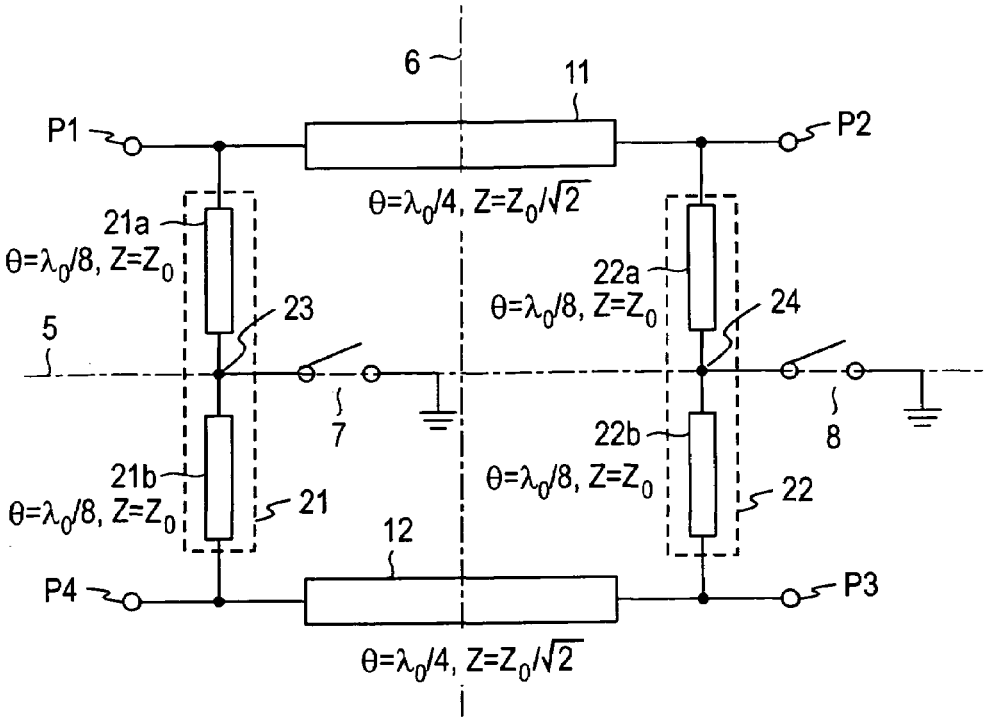
FIG. 1 is a diagram for explaining a first embodiment of the present invention.
Figure 25:
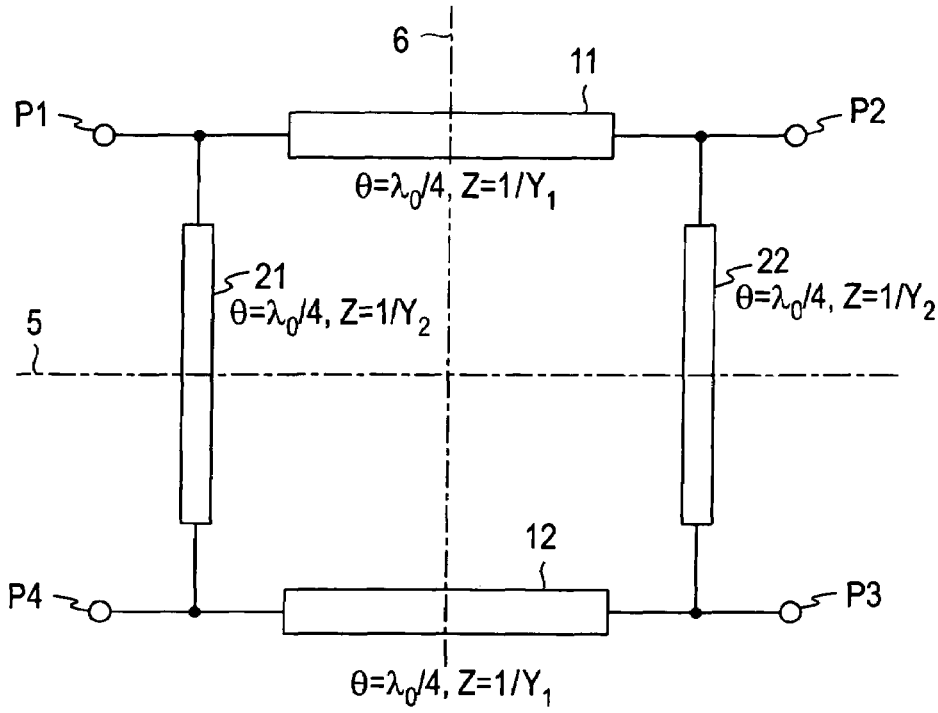
FIG. 25 is a diagram for explaining a prior art example of a branch-line hybrid circuit.

FIG. 1 illustrates an embodiment of the present invention applied to a 3 dB branch-line quadrature hybrid circuit. In FIG. 1 the parts corresponding to those in FIG. 25 are identified by the same reference numerals. As is the case with the prior art example of FIG. 25, transmission lines 11 and 12 of quarter-wave electrical length and characteristic impedance $Z_0/\sqrt{2}$ are connected between the ports P1 and P2 and between P4 and P3, respectively. Between the ports P1 and P4 and between P2 and P3 there are connected transmission lines 21 and 22 both having the quarter-wave electrical length and the characteristic impedance $Z_0$.

In the present invention, the transmission lines 21 and 22 are separated into transmission lines 21*a*, 22*a* and 21*b*, 22*b*, respectively, which are symmetrical with respect to their intermediate points of symmetry 23 and 24 through which the plane of symmetry 5 passes; and first and second SPST switches 7 and 8 are connected between the interconnection point 23 of the transmission line 21*a*, 21*b* and the ground and between the interconnection point 24 of the transmission lines 22*a*, 22*b* and the ground, respectively, so that their electromagnetic connection or coupling across the plane of symmetry 5 can be shorted to the ground in response to an external control signal for the switches.

The reference characters or symbols used herein are defined as listed below.

$Z_0$: Impedance of signal source and load $Y_0=1/Z_0$ $a_i$: Input signal to I/O port Pi (where i=1, 2, 3, 4)

$b_i$: Output signal from I/O port Pi (where i=1, 2, 3, 4)

$S_{ij}$: Scattering parameter from I/O port Pj to Pi (where i, j=1, 2, 3, 4)

From the definition of the scattering parameter $$b_1=S_{11}\times a_1+S_{21}\times a_2+S_{31}\times a_3+S_{41}\times a_4 \quad (1)$$

When the SPST switches 7 and 8 are both open, the quadrature hybrid circuit according to the present invention is equivalent to the prior art example of FIG. 25 that is a 3 dB quadrature hybrid circuit; hence, $$S_{11}=0,\ S_{21}=-j/\sqrt{2},\ S_{31}=-1/\sqrt{2},\ S_{41}=0$$

Next, a description will be given of the case where the SPST switches 7 and 8 are both closed. In this instance, it can be considered that the plane of symmetry 5 becomes equivalent to an electric wall. Since the quadrature hybrid circuit of the present invention has two planes of symmetry 5 and 6 and the respective I/O ports are symmetrical with respect to the planes of symmetry 5 and 6 accordingly, the symmetry is utilized in this case where the both switches are closed.

Figure 2A:
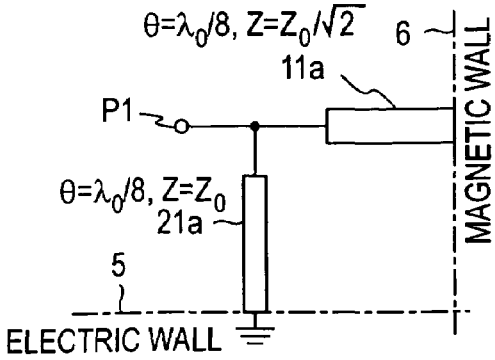
FIG. 2A is a diagram for explaining an equivalent circuit of the first embodiment.

In the first place, setting $$a_1=a_2=a_3=a_4=1$$

on the condition (A) that the I/O ports P1, P2, P3 and P4 are all excited by in-phase signals of a normalized amplitude, the plane of symmetry 6 becomes equivalent to a magnetic wall. As a result, such an equivalent circuit as shown in FIG. 2A is obtained which is composed of a transmission line 11*a* that is the one of two transmission lines into which the transmission line 11 is bisected along the plane of symmetry 6 and the transmission line 21*a* that is the one of the two transmission lines into which the transmission line 21 is bisected along the plane of symmetry 5. From the condition (A), the amplitude $a_1$ of the input signal to the port P1 is a normalized value, so that the reflection coefficient $\Gamma_a$ at the port P1, which is expressed by the ratio, $b_1(A)/a_1$, between the amplitude $b_1(A)$ of the output signal $b_1$ and the amplitude $a_1$ of the input signal at the port P1, is equal to $b_1(A)$. From Eq. (1), $$\Gamma_a=b_1(A)=S_{11}+S_{21}+S_{31}+S_{41} \quad (2)$$

Since the transmission line 11*a* is equivalent to an open-circuited ⅛-wavelength line of an characteristic impedance $Z_0/\sqrt{2}$, the input admittance of the line 11*a* is $j(\sqrt{2}Y_0)$. On the other hand, since the transmission line 21*a* is a short-circuited ⅛-wavelength line of a characteristic impedance $Z_0$, its input admittance is $-jY_0$. Therefore, the reflection coefficient $\Gamma_a$ is given by $$\begin{aligned}\Gamma_a &= (Y_0 - j(\sqrt{2}\,Y_0 - Y_0))/(Y_0 + j(\sqrt{2}\,Y_0 - Y_0)) \\ &= (1 - j(\sqrt{2} - 1))/(1 + j(\sqrt{2} - 1)) \\ &= (1 - j)/\sqrt{2}\end{aligned} \tag{3}$$

Then, setting $$a_1=a_2=-a_3=-a_4=1$$

on the condition (B) that the I/O ports P1 and P2 are excited by in-phase signals of a normalized amplitude and the I/O ports P3 and P4 by signals of normalized amplitude but 180° out of phase with the input signal to the port P1, the plane of symmetry 6 in this instance becomes equivalent to a magnetic wall, too. The resulting equivalent circuit is the same as in the case of the condition (A) shown in FIG. 2A. Since the amplitude of the input signal to the port P1 is a normalized value, the ratio, $b_1(B)/a_1=b_1(B)$, of an output signal $b_1(B)$ from the port P1 to an input signal $a_1$ thereto under the condition (B) is also equal to $\Gamma_a$. From Eq. (1), $$\Gamma_a=b_1(B)=S_{11}+S_{21}-S_{31}-S_{41} \tag{4}$$

Figure 2B:
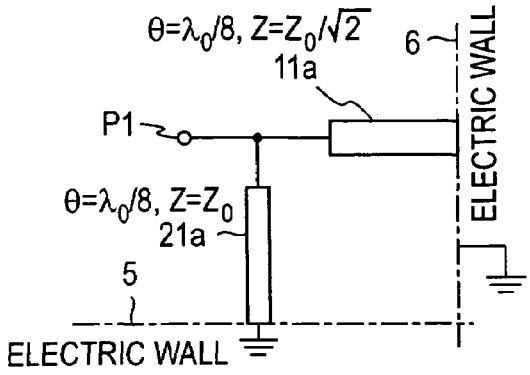
FIG. 2B is a diagram for explaining another equivalent circuit of the first embodiment.

Further, setting $$a_1=-a_2=a_3=-a_4=1$$

on the condition (C) that the I/O ports P1 and P3 are excited by in-phase signals of a normalized amplitude and the I/O ports P2 and P4 by signals of a normalized amplitude but 180° out of phase with the signal applied to the I/O port P1, the plane of symmetry 6 becomes equivalent to an electric wall, providing the equivalent circuit shown in FIG. 2B; and $b_1(C)$ is equal to the reflection coefficient $\Gamma_b$ of this circuit. From Eq. (1), $$\Gamma_b=b_1(C)=S_{11}-S_{21}+S_{31}-S_{41} \tag{5}$$

Since the transmission line 11*a* is equivalent to a short-circuited ⅛-wavelength line of characteristic impedance $Z_0/\sqrt{2}$, its input admittance is $-j(\sqrt{2}Y_0)$. On the other hand, since the transmission line 21*a* is a short-circuited ⅛-wavelength line of characteristic impedance $Z_0$, its input admittance is $-jY_0$. Therefore, the reflection coefficient $\Gamma_b$ is given by $$\begin{aligned}\Gamma_b &= (Y_0 - j(-\sqrt{2}\,Y_0 - Y_0))/(Y_0 + j(-\sqrt{2}\,Y_0 - Y_0)) \\ &= (1 + j(\sqrt{2} + 1))/(1 - j(\sqrt{2} + 1)) \\ &= -(1 - j)/\sqrt{2}\end{aligned} \tag{6}$$

Finally, setting $$a_1=-a_2=-a_3=a_4=1$$

on the condition (D) that the I/O ports P1 and P4 are excited by in-phase signals of a normalized amplitude and the I/O ports P2 and P3 by signals of a normalized amplitude but 180° out of phase with the signal applied to the I/O port P1, the plane of symmetry 6 becomes equivalent to an electric wall in this case, too. Hence, the equivalent circuit is the same as in the case of the condition (C) shown in FIG. 2B, and $b_1(D)$ is also equal to $\Gamma_b$. From Eq. (1), $$\Gamma_b=b_1(D)=S_{11}-S_{21}-S_{31}+S_{41} \tag{7}$$

From Eqs. (2) to (7) and the definition of scattering parameter, $$|S_{11}|^2+|S_{21}|^2+|S_{31}|^2+|S_{41}|^2=1 \tag{8}$$

from which are obtained $$S_{11}=0,\ S_{21}=(1-j)/\sqrt{2},\ S_{31}=0,\ S_{41}=0$$

Figure 19:
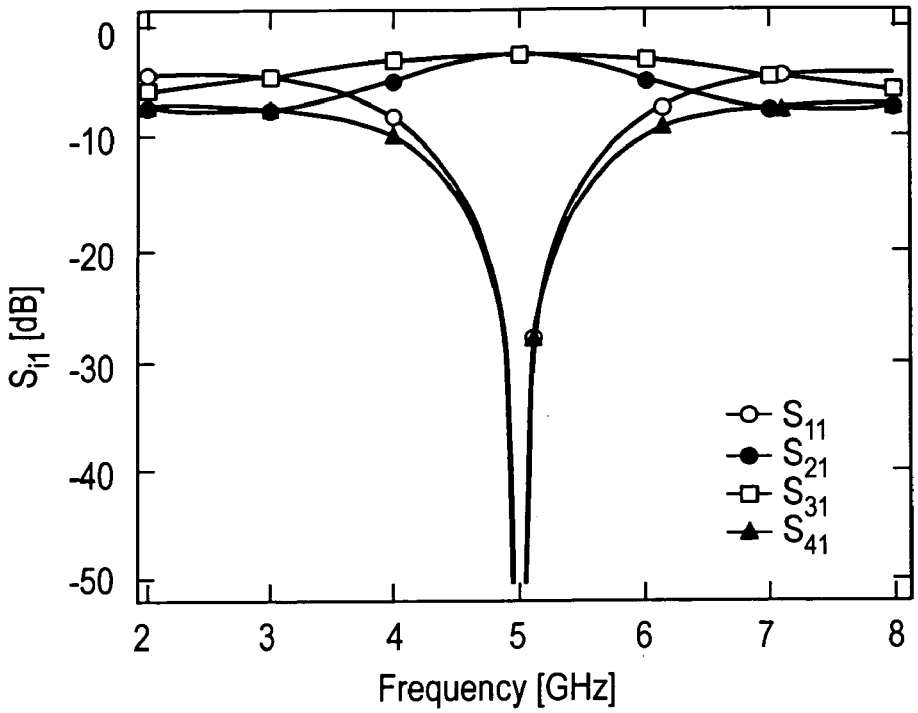
FIG. 19 is a graph showing simulation results with SPST switches opened in the first embodiment.

That is, the high-frequency signal input via the I/O port P1 is provided only to the I/O port P2 in a phase advanced by 45° while remaining unchanged in power, and no output is provided to the other I/O ports. When signals are input via the ports P2, P3 and P4 other than P1, it will be seen that the symmetry of this hybrid circuit provides:

Input to port P2: $S_{12}=(1-j)/\sqrt{2}$, $S_{22}=0$, $S_{32}=0$, $S_{42}=0$ Input to port P3: $S_{13}=0$, $S_{23}=0$, $S_{33}=0$, $S_{43}=(1-j)/\sqrt{2}$ Input to port P4: $S_{14}=0$, $S_{24}=0$, $S_{34}=(1-j)/\sqrt{2}$, $S_{44}=0$ FIG. 19 shows the results of simulation on the characteristics of the first embodiment designed for 5-GHz operation, with both of the SPST switches 7 and 8 held open. From FIG. 19, it can be seen that the signal input via the I/O port P1 is split equally between the I/O ports P2 and P3 and none is output to the I/O port P4.

Figure 20:
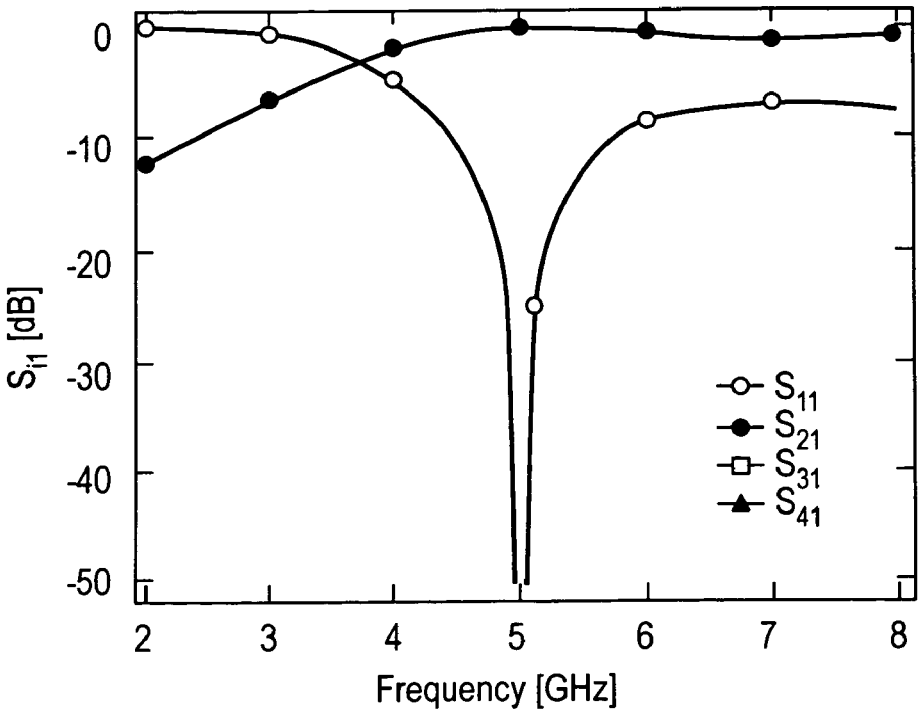
FIG. 20 is a graph showing simulation results with SPST switches closed in the first embodiment.

FIG. 20 shows the results of calculation of scattering parameters by simulation with both of the SPST switches 7 and 8 short-circuited. For the 5 GHz of high-frequency signal, the scattering parameter $S_{21}$ is substantially 0 dB, and the signal input via the I/O port P1 is provided to the I/O port P2 with substantially no loss in power. In FIG. 20, the scattering parameters $S_{31}$ and $S_{41}$ are both independent of frequency and lower than −60 dB, and they are not shown.

As will be evident from the above, in the first embodiment, when the SPST switches 7 and 8 are open, the port P1-P2 side and the port P4-P3 side of the quadrature hybrid circuit are electromagnetically connected or coupled to each other across the plane of symmetry 5 passing through the points 23 and 24 with respect to which each of the two-port circuit 21 and 22 is symmetrical, and the circuits between the four ports P1 to P4 function as a quadrature hybrid circuit. With the SPST switches 7 and 8 closed to ground, the electromagnetic connection or coupling across the plane of symmetry 5 is shorted to the ground. Further, in the state since matching of each port is also maintained the high-frequency signal input via the port P1, for instance, is output only to the port P2 without transmission loss, and none is provided to the other remaining ports.

As described above, according to the present invention, the electromagnetic connection or coupling across the plane of symmetry between the first-second I/O port side and the fourth-third I/O port side of the quadrature hybrid circuit is controlled by such circuit elements as the SPST switched 7 and 8. By this, it is possible to control the hybrid circuit to function as a quadrature hybrid for power division and power combination, or as a mere transmission line that does not perform power division and power combination. This principle is applicable to all of the embodiments of the present invention described later on. The following embodiments are all described as being applied to the branch-line quadrature hybrid circuit, but there is also known a quadrature hybrid circuit of the type in which the two-port circuits 21 and 22 in FIG. 1 are not used and both end portions of conductor traces of the transmission lines 11 and 12 are held close to each other to establish therebetween desired electromagnetic coupling. In such a quadrature hybrid circuit, too, the spatial electromagnetic coupling can be controlled in the plane of symmetry, for example, by means of a retractable electromagnetic shield plate.

Embodiment 2

Figure 3:
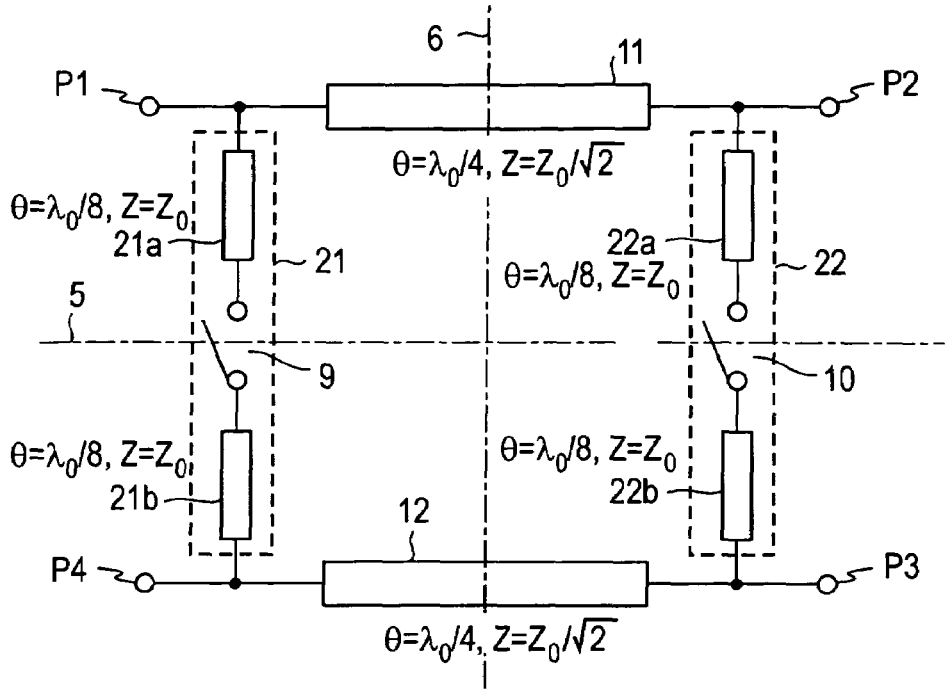
FIG. 3 is a diagram for explaining a second embodiment of the present invention.

Turning next to FIG. 3, a second embodiment of the present invention will be described below as being applied to a 3 dB branch-line quadrature hybrid circuit.

In this embodiment, the transmission line 21 is divided into equivalent transmission lines 21*a* and 21*b* each having a characteristic impedance nearly equal to $Z_0$ and an electrical length of approximately ⅛ wavelength, the transmission lines 21*a* and 21*b* being series-connected via an SPST switch 9, while the transmission line 22 is similarly divided into equivalent transmission lines 22*a* and 22*b* each having a characteristic impedance nearly equal to $Z_0$ and an electrical length of approximately ⅛ wavelength, the transmission lines 22*a* and 22*b* being series-connected via an SPST switch 10.

When the SPST switches 9 and 10 are both closed, $$S_{11}=0,\ S_{21}=-j/\sqrt{2},\ S_{31}=j/\sqrt{2},\ S_{41}=0$$

since the quadrature hybrid circuit of the present invention is equivalent to the conventional 3 dB quadrature hybrid circuit.

Next, a description will be given of the case where the SPST switches 9 and 10 are both open and hence it can be considered that the plane of symmetry 5 becomes equivalent to a magnetic wall. In this case, too, the circuit of the present invention has two planes of symmetry, with respect to which respective terminals are symmetrical, and the symmetry is utilized.

Figure 4A:
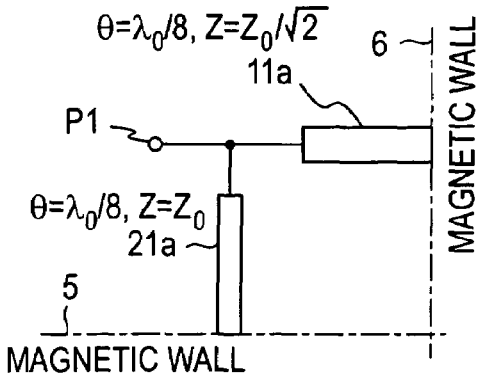
FIG. 4A is a diagram for explaining an equivalent circuit of the second embodiment.

In the first place, setting $$a_1=a_2=a_3=a_4=1$$

on the condition (A) that the I/O ports P1, P2, P3 and P4 are all excited by in-phase signals of a normalized amplitude, the plane of symmetry 6 becomes equivalent to a magnetic wall. As a result, such an equivalent circuit as shown in FIG. 4A is obtained, and $b_1(A)$ is equal to the reflection coefficient $\Gamma_c$ of this circuit. From Eq. (1), $$\Gamma_c=b_1(A)=S_{11}+S_{21}+S_{31}+S_{41} \tag{9}$$

Since the transmission line 11*a* is equivalent to an open-circuited ⅛-wavelength line of an characteristic impedance $Z_0/\sqrt{2}$, the input admittance of the line 11*a* is $j(\sqrt{2}Y_0)$. On the other hand, since the transmission line 21*a* is an open-circuited ⅛-wavelength line of a characteristic impedance $Z_0$, its input admittance is $jY_0$. Therefore, the reflection coefficient $\Gamma_c$ is given by $$\begin{aligned}\Gamma_c &= \left(Y_0 - j\left(-\sqrt{2}\,Y_0 + Y_0\right)\right)/\left(Y_0 + j\left(\sqrt{2}\,Y_0 + Y_0\right)\right)\\ &= \left(1 - j\left(\sqrt{2}+1\right)\right)/\left(1 + j\left(\sqrt{2}+1\right)\right)\\ &= (1+j)/\sqrt{2}\end{aligned} \tag{10}$$

Then, setting $$a_1=a_2=-a_3=-a_4=1$$

on the condition (B) that the I/O ports P1 and P2 are excited by in-phase signals of a normalized amplitude and the I/O ports P3 and P4 by signals of a normalized amplitude but 180° out of phase with the input signal to the I/O port P1, the plane of symmetry 6 becomes equivalent to a magnetic wall in this instance, too. The resulting equivalent circuit is the same as in the case of the condition (A), and $b_1(B)$ is also equal to $\Gamma_c$. From Eq. (1), $$\Gamma_c=b_1(B)=S_{11}+S_{21}-S_{31}-S_{41} \tag{11}$$

Figure 4B:
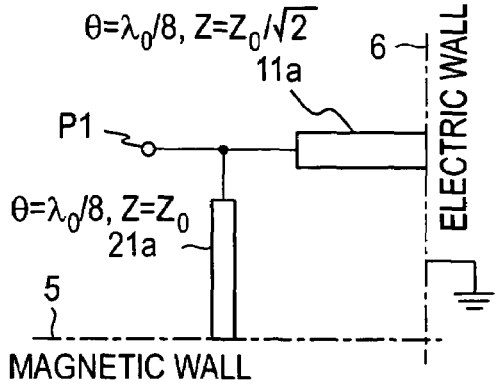
FIG. 4B is a diagram for explaining another equivalent circuit of the second embodiment.

Further, setting $$a_1=-a_2=a_3=-a_4=1$$

on the condition (C) that the I/O ports P1 and P3 are excited by in-phase signals of a normalized amplitude and the I/O ports P2 and P4 by signals of a normalized amplitude but 180° out of phase with the signal applied to the I/O port P1, the plane of symmetry 6 becomes equivalent to an electric wall, providing the equivalent circuit shown in FIG. 4B; and $b_1(C)$ is equal to the reflection coefficient $\Gamma_d$ of this circuit. From Eq. (1)

$$\Gamma_d=b_1(C)=S_{11}-S_{21}+S_{31}-S_{41} \tag{12}$$

Since the transmission line 11*a* is equivalent to a short-circuited ⅛-wavelength line of characteristic impedance $Z_0/\sqrt{2}$, its input admittance is $-j(\sqrt{2}Y_0)$. On the other hand, since the transmission line 21*a* is an open-circuited ⅛-wavelength line of characteristic impedance $Z_0$, its input admittance is $jY_0$. Therefore, the reflection coefficient $\Gamma_d$ is given by $$\begin{aligned}\Gamma_d &= \left(Y_0 - j\left(-\sqrt{2}\,Y_0 + Y_0\right)\right)/\left(Y_0 + j\left(-\sqrt{2}\,Y_0 + Y_0\right)\right)\\ &= \left(1 + j\left(\sqrt{2}-1\right)\right)/\left(1 - j\left(\sqrt{2}-1\right)\right)\\ &= (1+j)/\sqrt{2}\end{aligned} \tag{13}$$

Finally, setting $$a_1=-a_2=-a_3=a_4=1$$

on the condition (D) that the I/O ports P1 and P4 are excited by in-phase signals of a normalized amplitude and the I/O ports P2 and P3 by signals of a normalized amplitude but 180° out of phase with the signal applied to the I/O port P1, the plane of symmetry 6 becomes equivalent to an electric wall in this case, too. Hence, the equivalent circuit is the same as in the case of the condition (C), and $b_1(D)$ is also equal to $\Gamma_d$. From Eq. (1)

$$\Gamma_d=b_1(D)=S_{11}-S_{21}-S_{31}+S_{41} \tag{14}$$

From Eqs. (8) and (9) to (14)

$$S_{11}=0,\ S_{21}=-(1+j)/\sqrt{2},\ S_{31}=0,\ S_{41}=0$$

Figure 21:
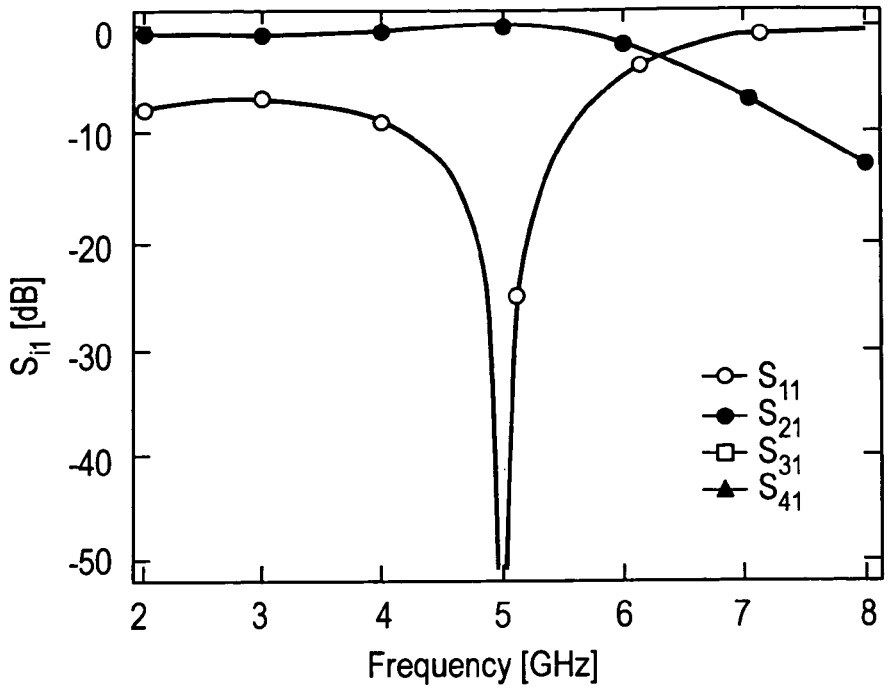
FIG. 21 is a graph showing simulation results with SPST switches opened in the second embodiment.

That is, the high-frequency signal input via the I/O port P1 is provided only to the I/O port P2 in a phase advanced by 135° without power loss, and no output is provided to the other I/O ports. When signals are input via the ports P2, P3 and P4 other than P1, it will be seen that the symmetry of this hybrid circuit provides:

Input to port P2: $S_{12}=-(1+j)/\sqrt{2}$, $S_{22}=0$, $S_{32}=0$, $S_{42}=0$ Input to port P3: $S_{13}=0$, $S_{23}=0$, $S_{33}=0$, $S_{43}=-(1+j)/\sqrt{2}$ Input to port P4: $S_{14}=0$, $S_{24}=0$, $S_{34}=-(1+j)/\sqrt{2}$, $S_{44}=0$ The results of simulation on the characteristics of the second embodiment designed for 5-GHz operation will be described below. When either of the SPST switches 9 and 10 is closed, the simulation results are the same as those in the case of FIG. 19; hence, the 5 GHz signal input via the I/O port P1 is divided equally between the I/O ports P2 and P3, and no signal is fed to the I/O port P4. FIG. 21 shows the results of simulation done with either of the SPST switches 9 and 10 opened. At 5 GHz, the scattering parameter $S_{21}$ is substantially 0 dB, and the signal fed via the I/O port P1 is provided to the I/O port P2 with substantially no loss. In FIG. 21 there are not shown the scattering parameters $S_{31}$ and $S_{41}$ since they are not frequency-dependent and are both below −60 dB.

Embodiment 3

Figure 5:
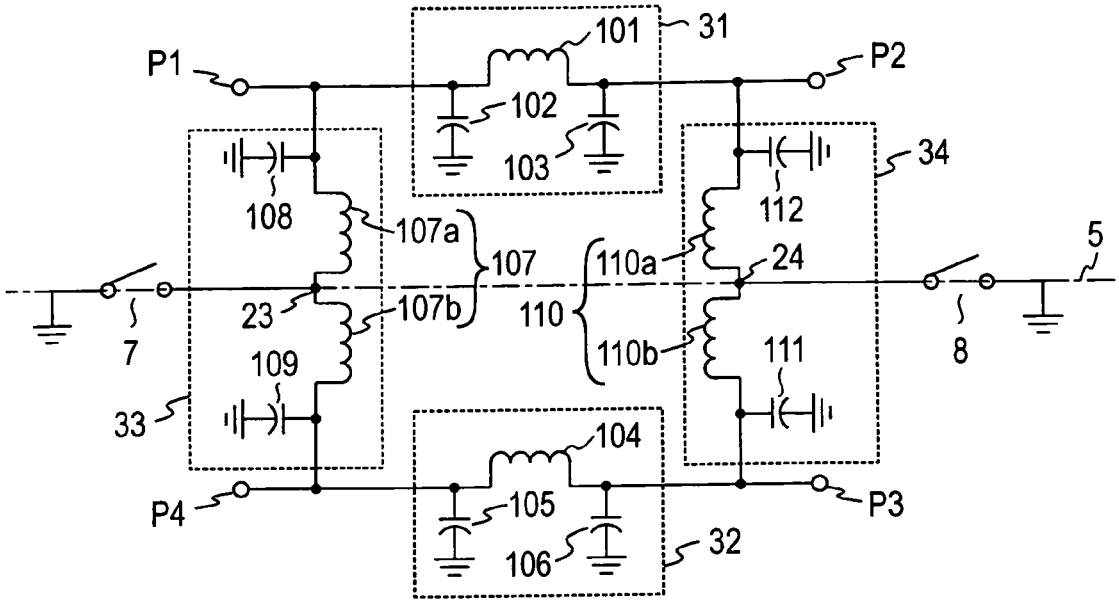
FIG. 5 is a diagram for explaining a third embodiment of the present invention.

Turning next to FIG. 5, a third embodiment of the present invention will be described below. FIG. 5 illustrates an example of a branch-line quadrature hybrid circuit according to this embodiment in which the transmission lines in FIG. 1 embodiment are implemented by equivalent lumped circuits as is the case with the FIG. 26 prior art example. The parts corresponding to those in FIG. 26 are identified by the same reference numerals.

In FIG. 5, the two-port circuit 31 corresponding to that 11 connected between the ports P1 and P2 in FIG. 1 is configured as a π-circuit composed of an inductor 101 connected between the ports P1 and P2 and capacitors 102 and 103 which are connected between one and the other ends of the inductor 101 and the ground, respectively. The two-port circuit 32 corresponding to that 12 between the ports P4 and P3 is also formed as such a π-circuit as mentioned above. The two-port circuit 33 corresponding to that 21 between the ports P1 and P4 in FIG. 1 is configured as a α-circuit composed of an inductor 107 connected between the ports P1 and P4 and capacitors 108 and 109 each connected between one and the other ends of the inductor 107 and the ground. Similarly, the two-port circuit 34 corresponding to that 22 between the ports P2 and P3 in FIG. 1 is also formed as such a π-circuit.

Figure 26:
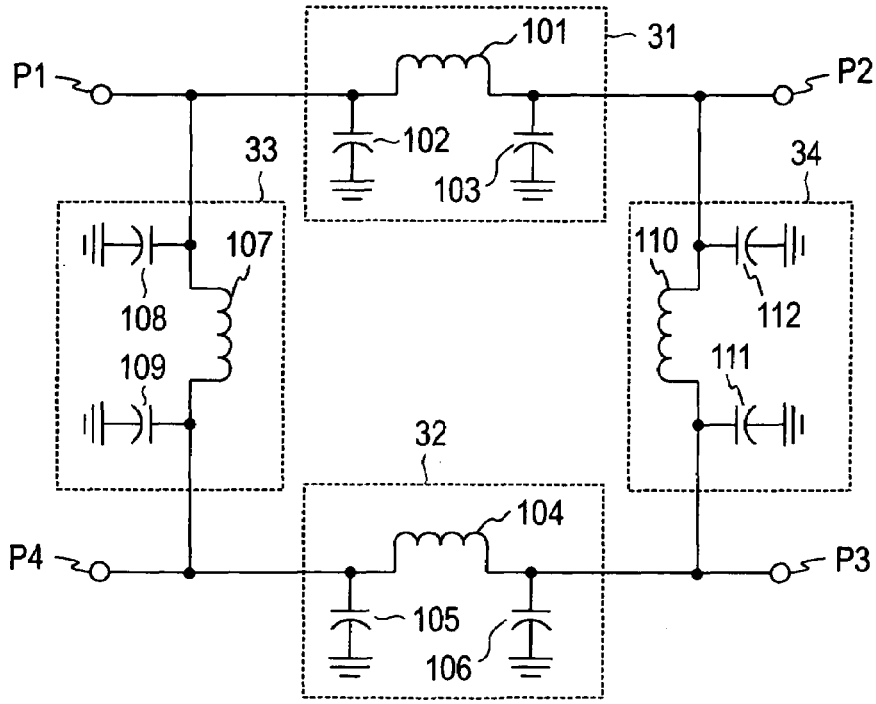
FIG. 26 PRIOR ART
FIG. 26 is a diagram showing an example of a conventional lumped hybrid circuit.

This embodiment differs from the FIG. 26 prior art example in the provision of SPST switches 7 and 8 by which the electromagnetic connection or coupling across the plane of symmetry 5 of the quadrature hybrid, which is characteristic of the present invention, can be shorted to the ground. That is, the inductor 107 of the two-port circuit 33 is divided into equivalent inductors 107*a* and 107*b*, and the SPST switch 7 is connected between their connection point (intermediate point of symmetry) 23 and the ground. Similarly, the inductor 110 is divided into equivalent inductors 110*a* and 110*b*, and the SPST switch 8 is connected between their connection point (intermediate point of symmetry) 24 and the ground.

In the hybrid circuit of this embodiment, letting a desired frequency be represented by $f_0$, inductances of the inductors 101 and 104 of the π-circuits 31 and 32 equivalent to the transmission lines 11 and 12 are each $Z_0/(\sqrt{2}\times 2\pi f_0)$, and the capacitance of each of the capacitors 102, 103, 105 and 106 is $\sqrt{2}/(2\pi f_0\times Z_0)$. The inductances of the inductors 107*a*, 107*b*, 110*a* and 110*b* of the π-circuits 33 and 34 equivalent to the transmission lines 21 and 22 in FIG. 1 are each $Z_0/4\pi f_0$, and the capacitances of the capacitors 108, 109, 111 and 112 are each $1/(2\pi f_0\times Z_0)$.

Accordingly, when the SPST switches 7 and 8 are open, the two-port circuits 33 and 34 in FIG. 5 each become equivalent at the frequency $f_0$ to a transmission line whose characteristic impedance Z is $Z_0$ and whose electrical length θ is approximately quarter-wave ($\theta=\lambda_0/4$), and the FIG. 5 circuit functions as a quadrature hybrid circuit. On the other hand, when the SPST switches 7 and 8 are closed, the aforementioned intermediate points of symmetry 23 and 24 are grounded. That is, the plane of symmetry 5 becomes equivalent to an electric wall; for example, a high-frequency signal fed via the I/O port P1 is provided only to the I/O port P2. Thus, this embodiment operates in the same manner as does the first embodiment of FIG. 1.

Embodiment 4

Figure 6:
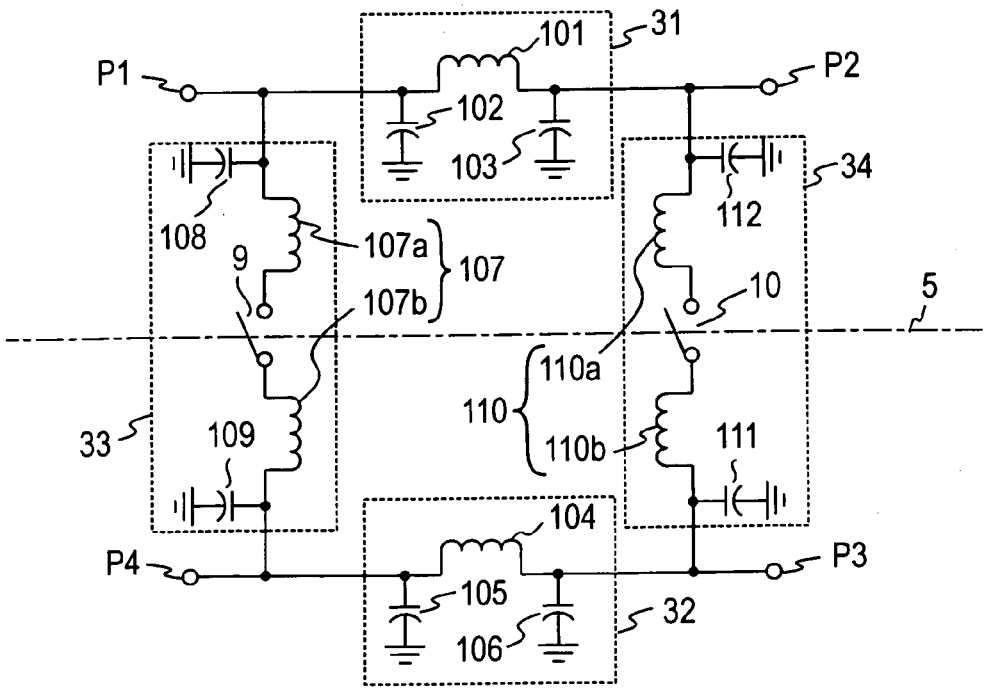
FIG. 6 is a diagram for explaining a fourth embodiment of the present invention.

FIG. 6 illustrates a fourth embodiment of the present invention, which is an example of a branch-line quadrature hybrid circuit of the type forming the respective transmission lines in the FIG. 3 embodiment by equivalent lumped circuits.

This embodiment differs from the FIG. 26 prior art example in the provision of SPST switches 9 and 10 by which the electromagnetic connection or coupling across the plane of symmetry 5 of the quadrature hybrid, which is characteristic of the present invention, can be made open in the plane 5. That is, the inductor 107 of the two-port circuit 33 is divided into equivalent inductors 107*a* and 107*b*, between which the SPST switch 9 is connected in series. Similarly, the inductor 110 is divided into equivalent inductors 110*a* and 110*b*, between which the SPST switch 10 is connected in series.

In the hybrid circuit of this embodiment, letting a desired frequency be represented by $f_0$, inductances of the inductors 101 and 104 of the π-circuits 31 and 32 equivalent to the transmission lines 11 and 12 in FIG. 3 are each $Z_0/(\sqrt{2}\times 2\pi f_0)$, and the capacitance of each of the capacitors 102, 103, 105 and 106 is $\sqrt{2}/(2\pi f_0\times Z_0)$. The inductances of the inductors 107*a*, 107*b*, 110*a* and 110*b* of the π-circuits 33 and 34 equivalent to the transmission lines 21 and 22 in FIG. 3 are each $Z_0/4\pi f_0$, and the capacitances of the capacitors 108, 109, 111 and 112 are each $1/(2\pi f_0\times Z_0)$.

Accordingly, when the SPST switches 9 and 10 are closed, the two-port circuits 33 and 34 in FIG. 6 each become equivalent at the frequency $f_0$ to a transmission line whose characteristic impedance Z is $Z_0$ and whose electrical length θ is approximately quarter-wave ($\theta=\lambda_0/4$), and the FIG. 6 circuit functions as a quadrature hybrid circuit. On the other hand, when the SPST switches 9 and 10 are open, the inductors 107 and 110 are each divided in the plane of symmetry 5. That is, the plane 5 of symmetry becomes equivalent to a magnetic wall; for example, a high-frequency signal fed via the I/O port P1 is provided only to the I/O port P2. Thus, this embodiment operates in the same manner as does the second embodiment of FIG. 3.

Embodiment 5

Figure 7:
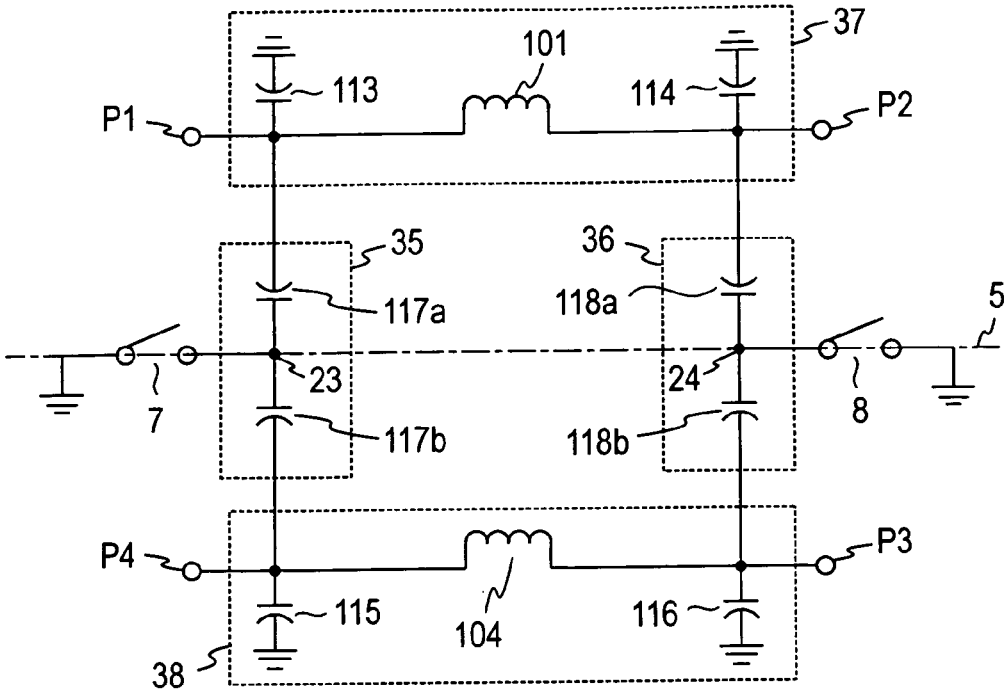
FIG. 7 is a diagram for explaining a fifth embodiment of the present invention.

FIG. 7 illustrates a fifth embodiment of the present invention. FIG. 7 also illustrates an example of a lumped branch-line quadrature hybrid circuit. In this embodiment, the two-port circuit 35 between the ports P1 and P4 has a series connection of capacitors 117*a* and 117*b* of the same capacitance, and an SPST switch 7 connected between their connection point (intermediate point of symmetry) 23 and the ground. Similarly, the two-port circuit 36 between the ports P2 and P3 also has a series connection of capacitors 118*a* and 118*b* of the same capacitance, and an SPST switch 8 connected between their connection point 24 and the ground. The two-port circuit 37 between the ports P1 and P2 is configured as a π-circuit composed of an inductor 101, and capacitors 113 and 114 connected between one and the other ends of the inductor 101 and the ground, respectively. Similarly, the two-port circuit 38 between the ports P4 and P3 is also configures as a π-circuit composed of an inductor 104 and capacitors 115 and 116 connected between one and the other ends of the inductor 104, respectively.

In the hybrid circuit of this embodiment, letting a desired frequency be represented by $f_0$, inductances of the inductors 101 and 104 of the π-circuits 37 and 38 are each given by $Z_0/(\sqrt{2}\times 2\pi f_0)$, and the capacitance of each of the capacitors 113, 114, 115 and 116 is given by $1/((1+\sqrt{2})\times 2\pi f_0\times Z_0)$. The capacitances of the capacitors 117*a*, 117*b*, 118*a* and 118*b* are each given by $2/(2\pi f_0\times Z_0)$.

This embodiment is equivalent to the first embodiment (FIG. 1) at the frequency $f_0$ and operates in the same way as does the latter. That is, when the SPST switches 7 and 8 are open, the circuit of FIG. 7 operates as a quadrature hybrid circuit. On the other hand, when the SPST switches 7 and 8 are closed to ground, a high-frequency signal input via the I/O port P1, for instance, is output to the I/O port P2 alone.

Figure 22:
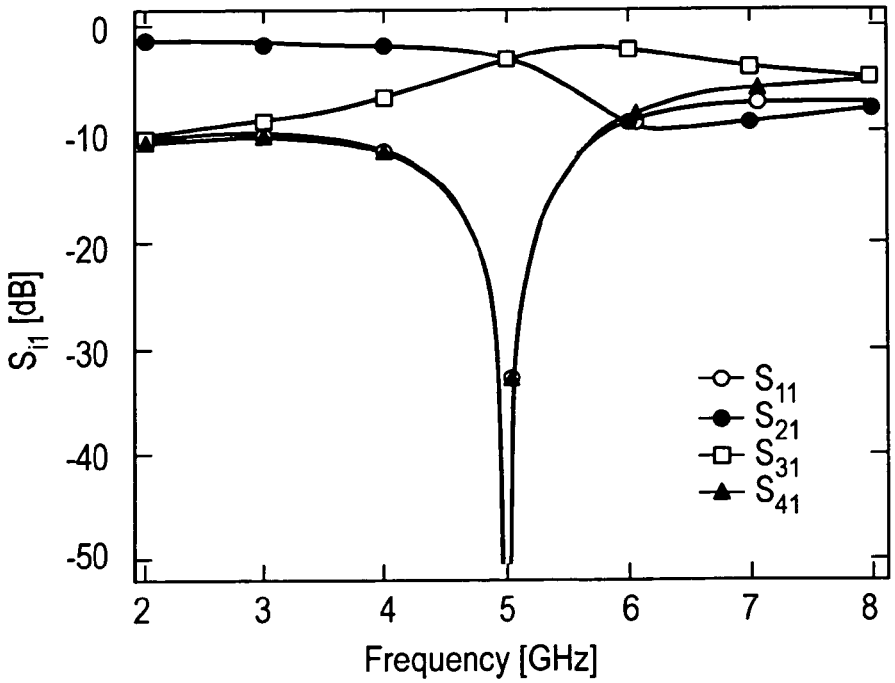
FIG. 22 is a graph showing simulation results with SPST switches opened in the fifth embodiment.
Figure 23:
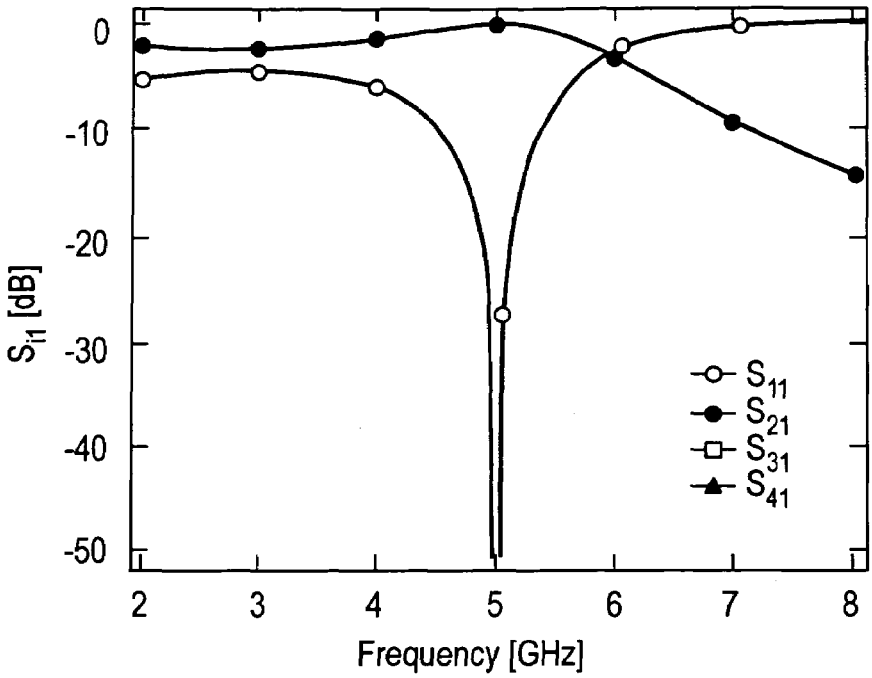
FIG. 23 is a graph showing simulation results with SPST switches closed in the fifth embodiment.

The results of simulation on the characteristics of the fifth embodiment designed for 5-GHz operation will be described below. FIG. 22 shows the results of simulation done with either of the SPST switches 7 and 8 held open; as will be seen from coincidence of the scattering parameters $S_{21}$ and $S_{31}$ at 5 GHz, a high-frequency signal fed via the I/O port P1 is split equally between I/O ports P2 and P3, but the scattering parameter $S_{41}$ is smaller than −50 dB and no output is provided to the I/O port P4. FIG. 23 shows the results of simulation done with either of the SPST switches 7 and 8 closed; the scattering parameter S21 is virtually 0 dB and the high-frequency signal fed via the I/O port P1 is provided to the I/O port with substantially no loss. In FIG. 23 there are not shown the scattering parameters $S_{31}$ and $S_{41}$ since they are not frequency-dependent and are both below −60 dB. In this case, no output is provided to the ports P3 and P4 accordingly.

Embodiment 6

Figure 8:
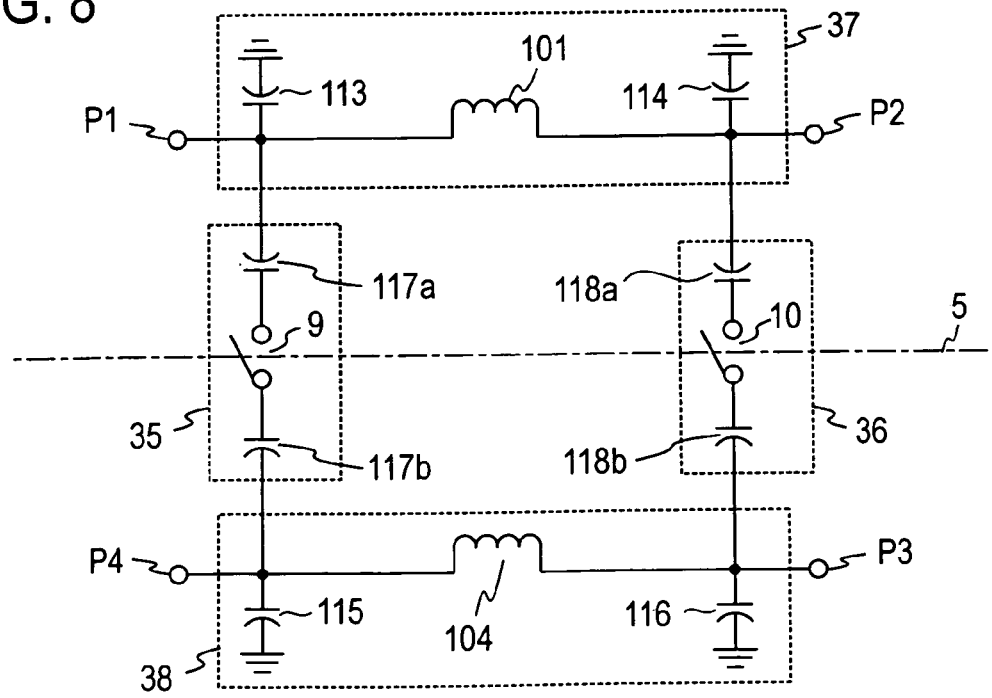
FIG. 8 is a diagram for explaining a sixth embodiment of the present invention.

FIG. 8 illustrates a sixth embodiment of the present invention. In this embodiment, the SPST switches 7 and 8 connected between the intermediate points of symmetry 23, 24 of the two-port circuits 35, 36 and the ground in the FIG. 7 embodiment are substituted with SPST switches 9 and 10 connected in series between the capacitors 117*a* and 117*b* and between the capacitors 118*a* and 118*b*, respectively. With the SPST switches 9 and 10 held open, the electromagnetic connection or coupling across the plane of symmetry 5 can be made open.

In the hybrid circuit of this embodiment, letting a desired frequency be represented by $f_0$, inductances of the inductors 101 and 104 forming the two-port circuits 31 and 32 are each given by $Z_0/(\sqrt{2}\times 2\pi f_0)$, and the capacitance of each of the capacitors 113, 114, 115 and 116 is given by $1/((1+\sqrt{2})\times 2\pi f_0\times Z_0)$. The capacitances of the capacitors 117*a*, 117*b*, 118*a* and 118*b* forming the two-port circuits 35 and 36 are each given by $2/(2\pi f_0\times Z_0)$.

This embodiment is equivalent to the second embodiment (FIG. 3) at the frequency $f_0$ and operates in the same way as does the latter. That is, when the SPST switches 9 and 10 are closed, the circuit of FIG. 8 operates as a quadrature hybrid circuit. On the other hand, when the SPST switches 9 and 10 are open, a high-frequency signal input via the I/O port P1, for instance, is output to the I/O port P2 alone.

The results of simulation on the characteristics of the sixth embodiment designed for 5-GHz operation will be described below.

Figure 24:
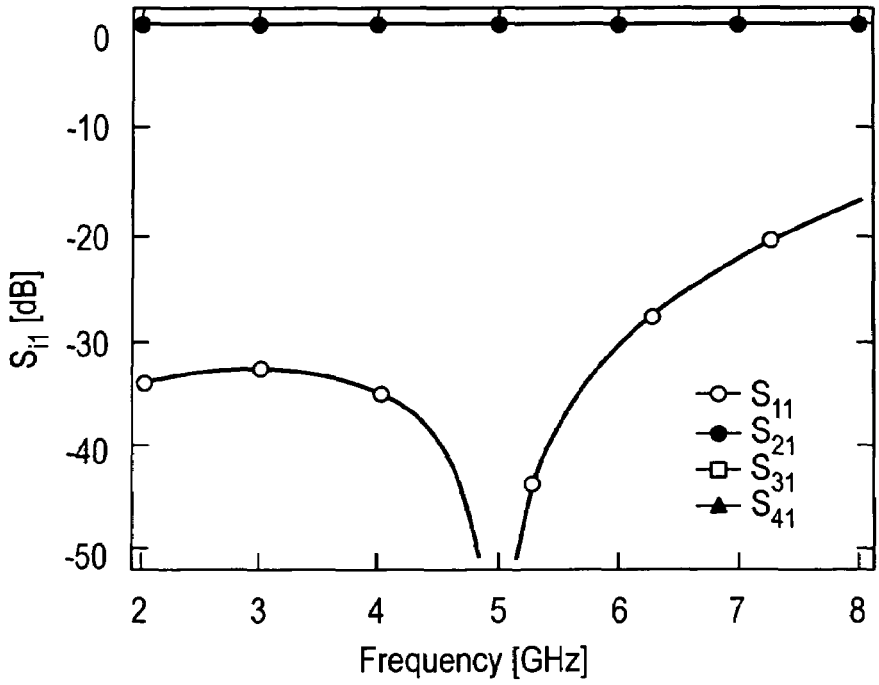
FIG. 24 is a graph showing simulation results with SPST switches opened in the sixth embodiment.

With either of the SPST switches 9 and 10 closed, the same results as shown in FIG. 22 are obtained; the high-frequency signal fed via the I/O port P1 is split equally between I/O ports P2 and P3 and none is output to the I/O port P4. FIG. 24 shows the results of simulation done with either of the SPST switches 9 and 10 held open; the scattering parameters $S_{21}$ is approximately 0 dB at 5 GHz and the high-frequency signal input via the I/O port P1 is output to the I/O port P2 with substantially no loss. In FIG. 24, there are not shown the scattering parameters $S_3$, and $S_{41}$ since they are not frequency-dependent and are both below −60 dB.

Embodiment 7

Figure 9:
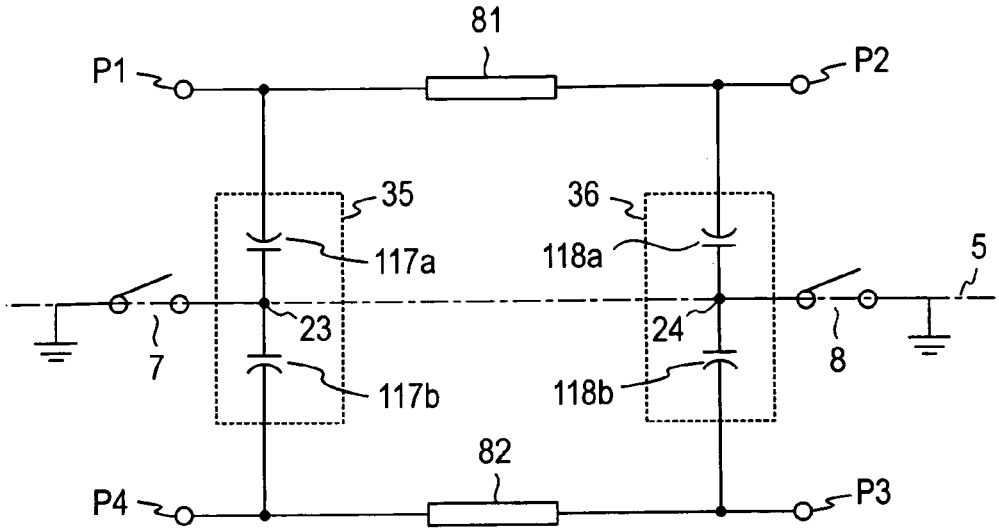
FIG. 9 is a diagram for explaining a seventh embodiment of the present invention.

FIG. 9 illustrates a seventh embodiment of the present invention. In this embodiment, the two-port circuits formed by the π-circuits 37 and 38 in the FIG. 7 embodiment are substituted by transmission lines 81 and 82. As in the case of the FIG. 7 embodiment, the SPST switches 7 and 8 are connected between the connection point 23 and the ground and between the connection point 24 and the ground, respectively.

In the hybrid circuit of this embodiment, letting a desired frequency be represented by $f_0$, the transmission lines 81 and 82 each have a characteristic impedance $Z=Z_0$ and at the frequency $f_0$ an approximately ⅛-wave electrical length θ, and the capacitance of each of the capacitors 117*a*, 117*b*, 118*a* and 118*b* is $2/(2\pi f_0\times Z_0)$.

This embodiment is equivalent to the first embodiment (FIG. 1) at the frequency $f_0$ and operates in the same way as does the latter. That is, when the SPST switches 7 and 8 are open, the circuit of FIG. 9 operates as a quadrature hybrid circuit. On the other hand, when the SPST switches 7 and 8 are closed, the high-frequency signal input via the I/O port P1, for instance, is output to the I/O port P2 alone.

Embodiment 8

Figure 10:
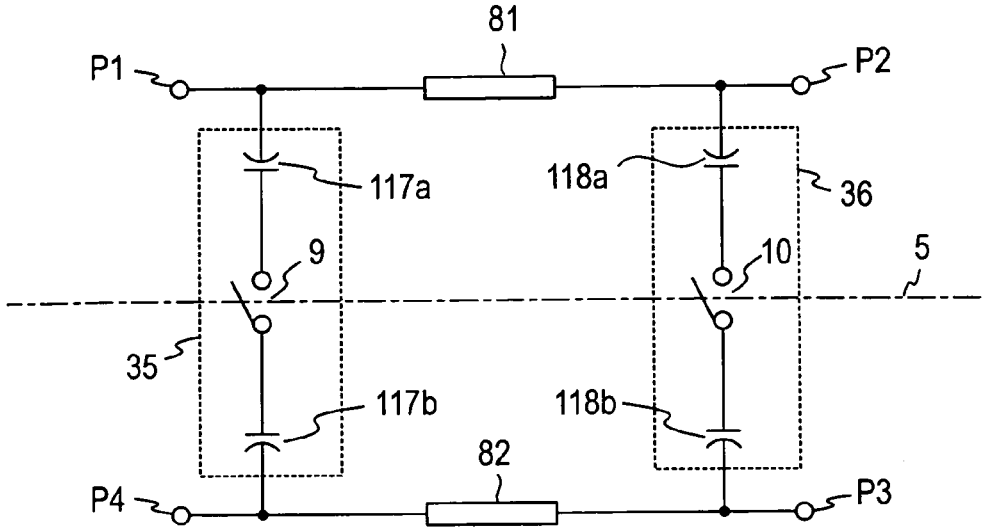
FIG. 10 is a diagram for explaining an eighth embodiment of the present invention.

FIG. 10 illustrates an eighth embodiment of the present invention. In this embodiment, the two-port circuits formed by the π-circuits 37 and 38 in the FIG. 8 embodiment are formed by transmission lines 81 and 82. As in the case of the FIG. 8 embodiment, the SPST switches 9 and 10 are connected in series between the capacitors 117*a* and 117*b* and between the capacitors 118*a* and 118*b*, respectively.

In the hybrid circuit of this embodiment, letting a desired frequency be represented by $f_0$, the transmission lines 81 and 82 each have a characteristic impedance $Z=Z_0$ and at the frequency $f_0$ an approximately ⅛-wave electrical length θ, and the capacitance of each of the capacitors 117*a*, 117*b*, 118*a* and 118*b* is $2/(2\pi f_0\times Z_0)$.

This embodiment is equivalent to the second embodiment (FIG. 3) at the frequency $f_0$ and operates in the same way as does the latter. That is, when the SPST switches 9 and 10 are closed, the circuit of FIG. 10 operates as a quadrature hybrid circuit. On the other hand, when the SPST switches 9 and 10 are open, the high-frequency signal input via the I/O port P1, for instance, is output to the I/O port P2 alone.

Embodiment 9

Figure 11:
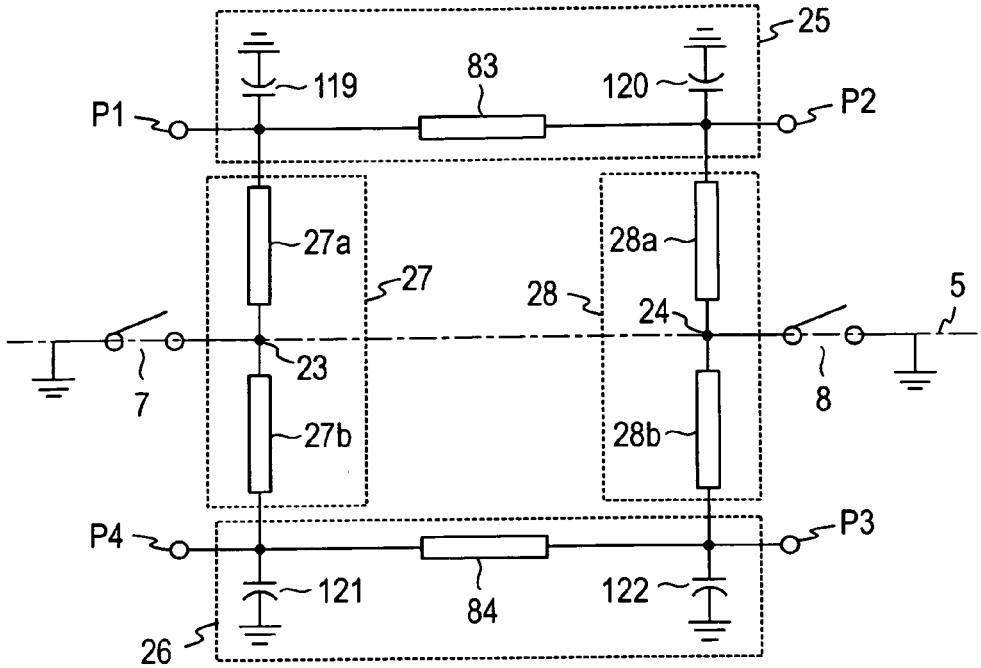
FIG. 11 is a diagram for explaining a ninth embodiment of the present invention.

FIG. 11 illustrates a ninth embodiment of the present invention. The two-port circuit 25 between the ports P1 and P2 is composed of a transmission line 83 inserted between the ports P1 and P2, and capacitors 119 and 120 connected between one and the other ends of the line 83 and the ground, respectively. Similarly, the two-port circuit 26 between the ports P4 and P3 is also made up of a transmission line 84 inserted between the ports P1 and P2, and capacitors 121 and 122 connected between one and the other ends of the line 84 and the ground, respectively. The two-port circuits between the ports P1 and P4 and between P2 and P3 are formed by the transmission lines 27 and 28, respectively. The intermediate point 23 divides transmission line 27 into equivalent transmission lines 27*a* and 27*b*, and the SPST switch 7 is inserted between the intermediate point 23 and the ground. Similarly, the intermediate point 24 divides the transmission line 28 into equivalent transmission lines 28*a* and 28*b*, and the SPST switch 8 is inserted between the intermediate point 24 and the ground.

In the hybrid circuit of this embodiment, letting a predetermined frequency be represented by $f_0$, the transmission lines 83 and 84 each have a characteristic impedance $Z=\sqrt{2}Z_0$ and, at the frequency $f_0$, an approximately 1/12-wave electrical length θ, and the capacitance of each of the capacitors 119, 120, 121 and 122 is $(0.5^{1/2}+1.5^{1/2})/(2\pi f_0\times Z_0)$.

The transmission lines 27*a*, 27*b* and 28*a*, 28*b*, which form the two-port circuits 27 and 28, are transmission lines whose characteristic impedances Z are $\sqrt{2}Z_0$ and electrical lengths θ are approximately 1/16 wavelength at the frequency $f_0$.

This embodiment is equivalent to the first embodiment (FIG. 1) at the frequency $f_0$, and operates in the same way as does the latter. That is, when the SPST switches 7 and 8 are open, this embodiment operates as a quadrature hybrid circuit. When the SPST switches 7 and 8 are closed to ground, the high-frequency signal fed via the I/O port P1, for instant, is provided only to the I/O port P2.

Embodiment 10

Figure 12:
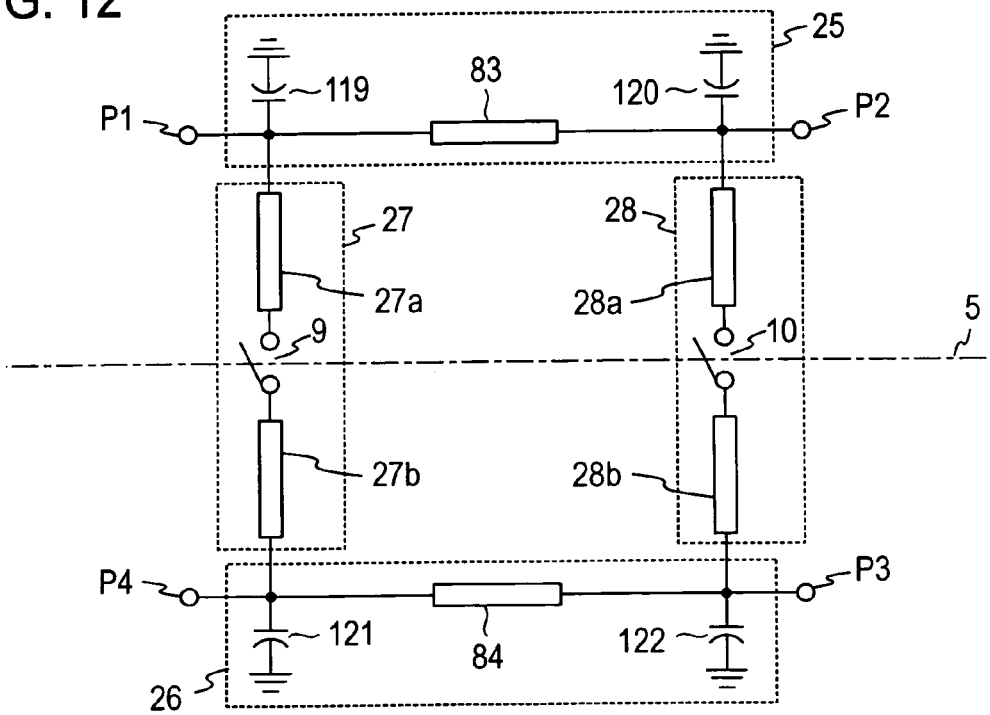
FIG. 12 is a diagram for explaining a tenth embodiment of the present invention.

FIG. 12 illustrates a tenth embodiment of the present invention. This embodiment is a modified form of the FIG. 11 embodiment, in which the SPST switches 7 and 8 connected between the points 23, 24 the ground in the latter are replaced with SPST switches 9 and 10 connected in series between the transmission lines 27*a* and 27*b* and between the transmission lines 28*a* and 28*b*.

In the hybrid circuit of this embodiment, letting a predetermined frequency be represented by $f_0$, the transmission lines 83 and 84 each have a characteristic impedance $Z=\sqrt{2}Z_0$ and at the frequency $f_0$ an approximately 1/12-wave electrical length θ, and the capacitance of each of the capacitors 119, 120, 121 and 122 is $(0.5^{1/2}+1.5^{1/2})/(2\pi f_0\times Z_0)$.

The transmission lines 27*a*, 27*b* and 28*a*, 28*b*, which form the two-port circuits 27 and 28, are transmission lines whose characteristic impedances Z are $\sqrt{2}Z_0$ and electrical lengths θ are approximately 1/16 wavelength at the frequency $f_0$.

This embodiment is equivalent to the second embodiment (FIG. 3) at the frequency $f_0$, and operates in the same way as does the latter. That is, when the SPST switches 9 and 10 are closed, this embodiment operates as a quadrature hybrid circuit. When the SPST switches 9 and 10 are open, the high-frequency signal fed via the I/O port P1, for instant, is provided only to the I/O port P2.

The above-described embodiments each implement the intended operations by means of circuit elements responsive to an external control signal to control the boundary condition on the plane of symmetry 5 along which the two-port circuit between the I/O ports P1 and P4 of the quadrature hybrid circuit and the two-port circuit between the I/O ports P2 and P3 are separated symmetrical to each other. The constituents of the hybrid circuit may be transmission circuits, lumped elements such as inductors and capacitors, or any combinations thereof.

Embodiment 11

Figure 13:
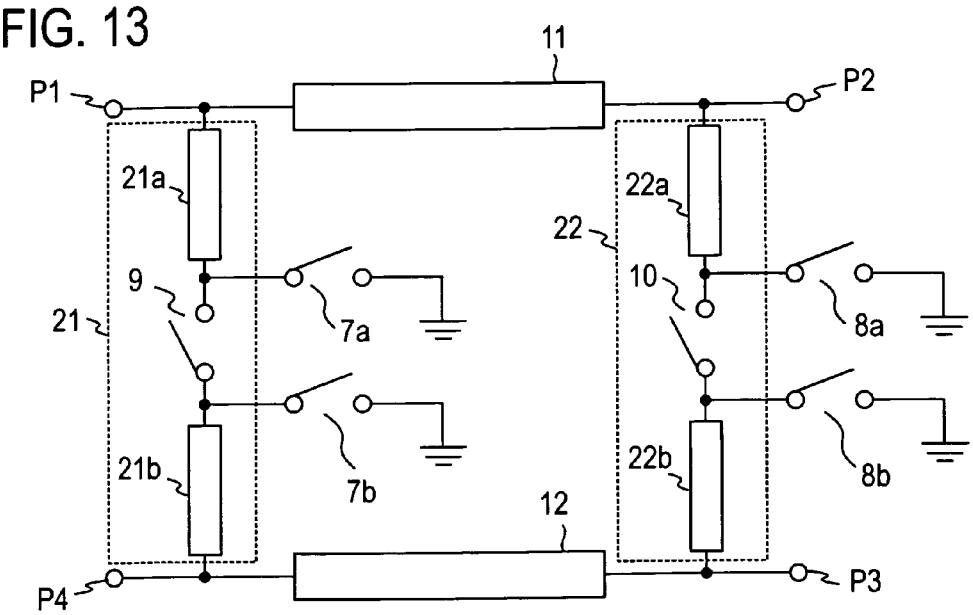
FIG. 13 is a diagram for explaining eleventh and twelfth embodiments of the present invention.

FIG. 13 illustrates an eleventh embodiment of the present invention. This embodiment is a modified form of the FIG. 3 embodiment, which has SPST switches 7*a* and 7*b* inserted between one and the other ends of the SPST switch 9 and the ground, respectively, and SPST switches 8*a* and 8*b* similarly inserted between one and the other ends of the SPST switch 10 and the ground, respectively. The electrical lengths and characteristic impedances of the transmission lines 11, 12, 21*a*, 21*b*, 22*a* and 22*b* are the same as the corresponding values in FIG. 3.

The illustrated hybrid circuit operates as a quadrature hybrid circuit when the SPST switches 9 and 10 are held closed and the SPST switches 7*a*, 7*b* and 8*a*, 8*b* are held open. When the SPST switches 9 and 10 are also opened, the power input to the I/O port P1 is output only to the I/O port P2 and none is provided to the other I/O ports.

With this 3 dB quadrature hybrid circuit, it is possible to change the phase shift between the I/O ports P1 and P2, or between P3 and P4 by controlling the SPST switches 7*a*, 7*b* and 8*a*, 8*b* while holding the SPST switches 9 and 10 open as described below.

The phase shift between the I/O ports P1 and P2 will be described. When the SPST switches 7*a* and 8*a* are open with the SPST switches 9 and 10 held open, the high-frequency signal fed via the I/O port P1 is output only to the I/O port P2 without transmission loss but in a 135° advanced phase as in the case of the second embodiment (FIGS. 3 and 8) of the invention applied to the branch-line quadrature hybrid circuit. On the other hand, when the SPST switches 9 and 10 are open but the SPST switches 7*a* and 8*a* are closed, the high-frequency signal fed via the I/O port P1 is output only to the I/O port P2 without transmission loss but in a 45° advanced phase as in the case of the first embodiment (FIGS. 1 and 7) of the invention applied to the branch-line quadrature hybrid circuit. Accordingly, by selectively opening or closing the above SPST switches, it is possible to switch the phase of the input signal between 90° and 0° during its propagation from the I/O port P1 to P2.

These modes of operation may be summarized as listed below.

(a) Switches 9 and 10 closed, switches 7*a*, 7*b* and 8*a*, 8*b* open: Operation as a quadrature hybrid.

(b) Switches 9 and 10 open, switches 7*a* and 8*a* closed: −45° phase shift between I/O ports P1 and P2.

(c) Switches 9 and 10 open, switches 7*a* and 8*a* open: −135° phase shift between I/O ports P1 and P2.

(d) Switches 9 and 10 open, switches 7*b* and 8*b* closed: −45° phase shift between I/O ports P4 and P3.

(e) Switches 9 and 10 open, switches 7*b* and 8*b* open: −135° phase shift between I/O ports P4 and P3.

Figure 16:
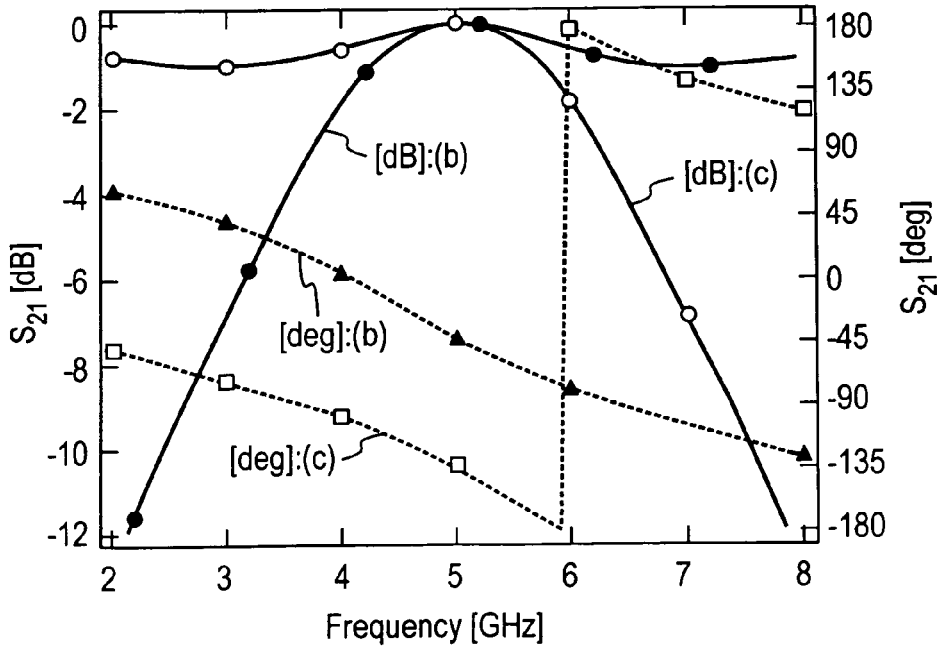
FIG. 16 is a graph showing simulation results with SPST switches closed or opened in the eleventh embodiment.

In FIG. 16 there are shown the simulation results in the above-mentioned modes (b) and (c) on the 3 dB quadrature hybrid circuit of the present invention designed for operation at 5 GHz. The solid lines each indicate the level ratio between the input signal to the port P1 and the output signal from the port P2 (that is, the scattering parameter $S_{21}$), and the broken lines each indicate phase. It can be seen from FIG. 16 that in either of modes (b) and (c) the signal is output to the port P2 with substantially no loss at 5 GHz. In mode (b) the phase of the output signal is about −45°, and in mode (c) the phase of the output signal is −135°.

When no phase control is needed between the I/O ports P1 and P2, the SPST switches 7*a* and 8*a* may be omitted. When no phase control is needed between the I/O ports P4 and P3, the SPST switches 7*b* and 8*b* may be omitted. The transmission lines 11, 12, 21*a*, 21*b*, 22*a* and 22*b* used in this embodiment may each be replaced with an arbitrary circuit that exhibits equivalent characteristics at the intended frequency $f_0$.

Modified Embodiments

While in the above the present invention has been described as being applied to the 3 dB quadrature hybrid circuit, the invention is applicable as well to quadrature hybrid circuits of coupling other than 3 dB as described below.

Turning back to FIG. 13, the electrical lengths and characteristic impedances of the transmission lines 11, 12, 21*a*, 21*b*, 22*a* and 22*b* have been described as being equal to the values of their counterparts in the FIG. 13 embodiment, but according to this modified embodiment, by setting the characteristic impedances of the quarter-wave transmission lines 11 and 12 at 44.7 Ω and the characteristic impedances of the ⅛-wave transmission lines 21*a*, 21*b*, 22*a* and 22*b* at 100Ω, the FIG. 13 circuit can be formed as a 7 dB quadrature hybrid circuit. Incidentally, from Eq. (ii) the input impedance at each port is $Z_0$=50 Ω.

Figure 17:
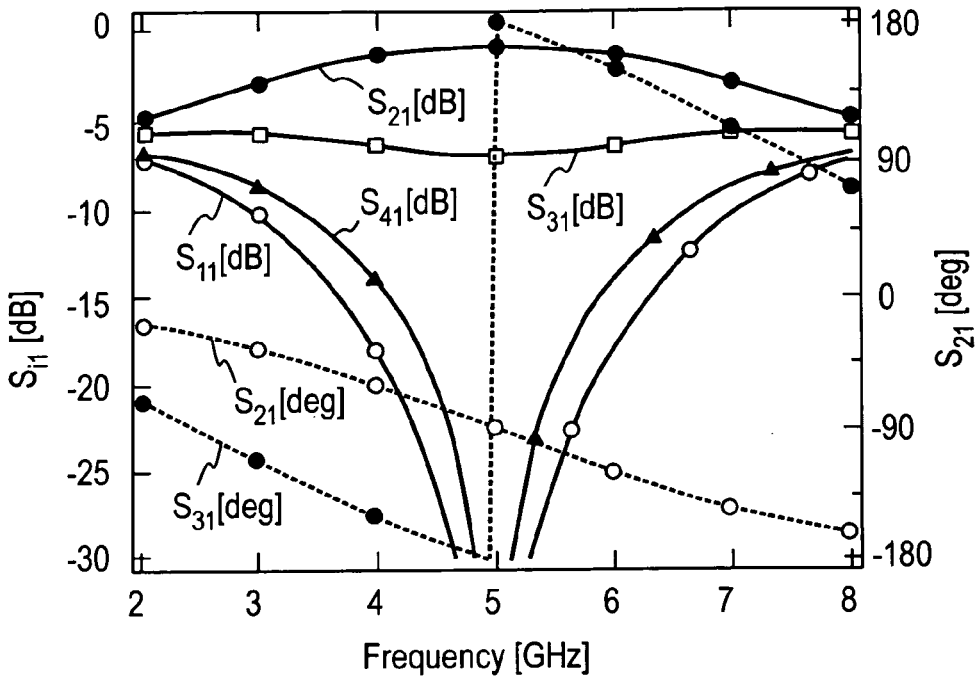
FIG. 17 is a graph showing simulation results during the hybrid-circuit operation of the twelfth embodiment.

FIG. 17 is a graph showing the results of simulation performed on the modified form of the FIG. 13 designed for 5 GHz in the following mode of operation:

(f) SPST switches 9 and 10 are closed and SPST switches 7*a*, 7*b*, 8*a* and 8*b* are open.

The solid lines indicate values of scattering parameters (input-output level ratios), and the broken lines indicate phase shift amounts. At 5 GHz the scattering parameter $S_3$, is −7 dB which represents the level ratio of the output signal at the port P3 to the input signal at the port P1, and the phase difference between the scattering parameters $S_{21}$, and $S_{31}$ is 90°; hence, it can be seen that this circuit operates as a quadrature hybrid circuit in this instance.

Figure 18:
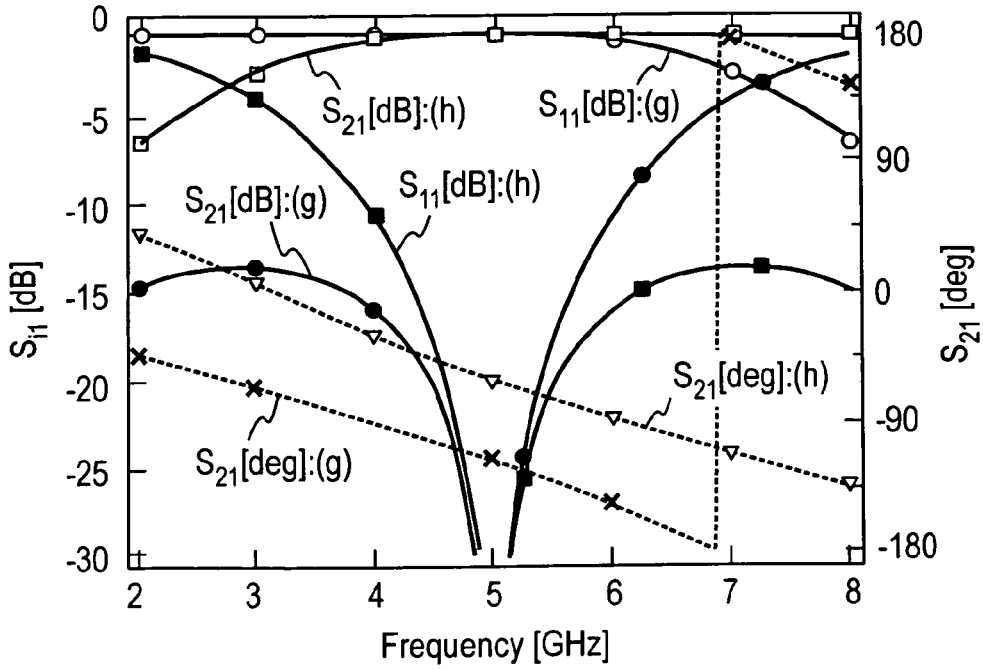
FIG. 18 is a graph showing simulation results with SPST switches 9 and 10 closed and SPST switches 7*a*, 7*b*, 8*a* and 8*b* closed or opened in the twelfth embodiment.

FIG. 18 is a graph showing the results of simulation performed on the modification of the FIG. 13 designed for 5 GHz in the following modes of operation:

(g) SPST switches 9 and 10 open, SPST switches 7*a* and 8*a* open; and (h) SPST switches 9 and 10 open, SPST switches 7*a* and 8*a* closed. In either mode, since the scattering parameter $S_{21}$ is approximately 0 dB at 5 GHz, the high-frequency signal fed via the I/O port P1 is output intact only to the I/O port P2. In this instance, when the SPST switches 7*a* and 8*a* are open, the phase of the scattering parameter $S_{21}$ is −116.6°, whereas when the SPST switches 7*a* and 8*a* are closed, it is −63.4°. Accordingly, by opening or closing the SPST switches 7*a* and 8*a* after opening the SPST switches 9 and 10, it is possible to switch the phase of the input signal between approximately 53° and 0° during its propagation from the I/O port P1 to P2. By similar control of the SPST switches 7*b* and 8*b*, the phase of the signal from the I/O port P4 to P3 can also be controlled in the same way as mentioned above.

When no phase control is needed between the I/O ports P1 and P2, the SPST switches 7*a* and 8*a* may be omitted. When no phase control is needed between the I/O ports P4 and P3, the SPST switches 7*b* and 8*b* may be omitted. One or more of the transmission lines 11, 12, 21*a*, 21*b*, 22*a* and 22*b* may be replaced with arbitrary circuits that exhibits equivalent characteristics at the intended frequency $f_0$.

Figure 14A:
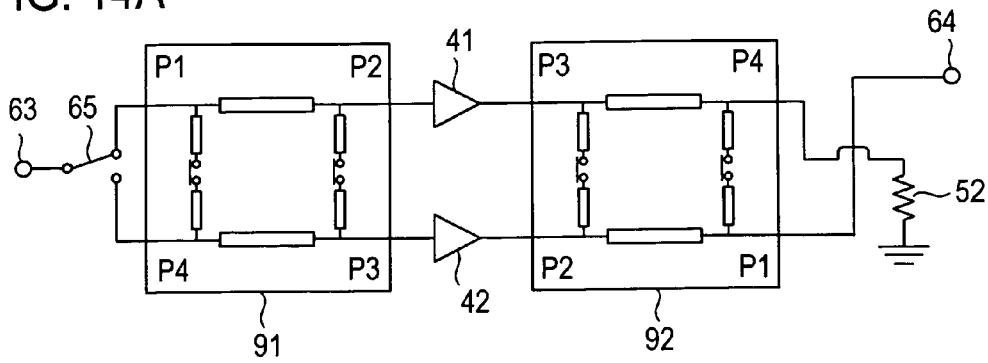
FIG. 14A is a diagram for explaining the one operation of a parallel operation amplifier using an embodiment of the quadrature hybrid circuit.
Figure 14B:
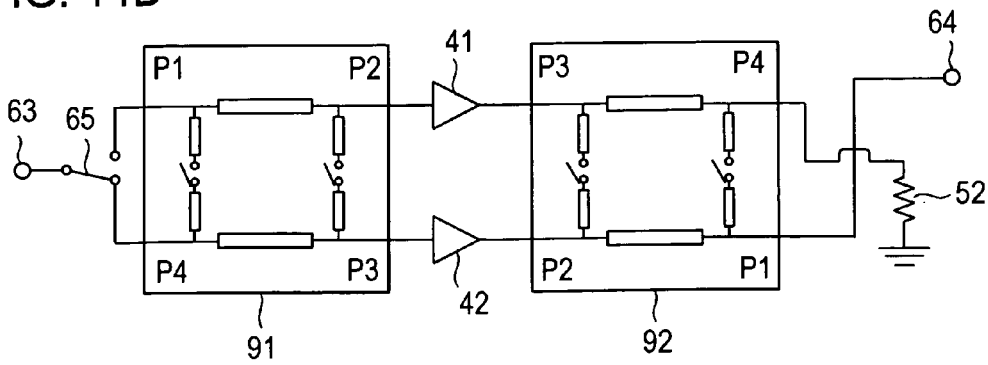
FIG. 14B is a diagram for explaining the other operation of the parallel operation amplifier of FIG. 14A.

FIGS. 14A and 14B illustrate an example of the quadrature hybrid circuit of the present invention as being applied to a parallel operation amplifier. Reference numeral 41 and 42 denote power amplifiers; 91 and 92 denote quadrature hybrid circuits of the present invention; P1 to P4 denote the afore-mentioned I/O port numbers; 65 denotes an SPST switch; 52 denotes a matching resistor (resistance $Z_0$); 63 denotes a signal input terminal; and 64 denotes a signal output terminal. If the power amplifiers 41 and 42 are equivalent, 3 dB quadrature hybrid circuits are used as the quadrature hybrid circuits 91 and 92.

By turning ON the power amplifiers 41 and 42, then connecting the SPDT switch 65 to the I/O port P1 of the quadrature hybrid circuit 91 as shown in FIG. 14A, and controlling switches of the quadrature hybrid circuits 91 and 92 to permit it to perform the hybrid operation, a high-frequency signal of the frequency $f_0$ input via the signal input terminal 63 is divided by the quadrature hybrid circuit into two, then the two signals are amplified by the power amplifiers 41 and 42, and combined by the quadrature hybrid circuit 92, and the combined signal is provided to the signal output terminal 64.

By turning ON the power amplifier 42, then connecting the SPDT switch 65 to the I/O port P4 of the quadrature hybrid circuit 91 as shown in FIG. 14B, and controlling switches of the quadrature hybrid circuits 91 and 92 to inhibit the power division and combination, the high-frequency signal of the frequency $f_0$ fed via the input terminal 63 is applied only to and amplified by the power amplifier 42, and the amplified signal is provided intact via the quadrature hybrid circuit 92 to the output terminal 64. In this case, the power supply to the power amplifier 41 is stopped, and hence its power consumption is reduced. While in FIGS. 14A and 14B the quadrature hybrid circuit of the second embodiment is used, the hybrid circuits of the other embodiments can also be used.

Figure 15A:
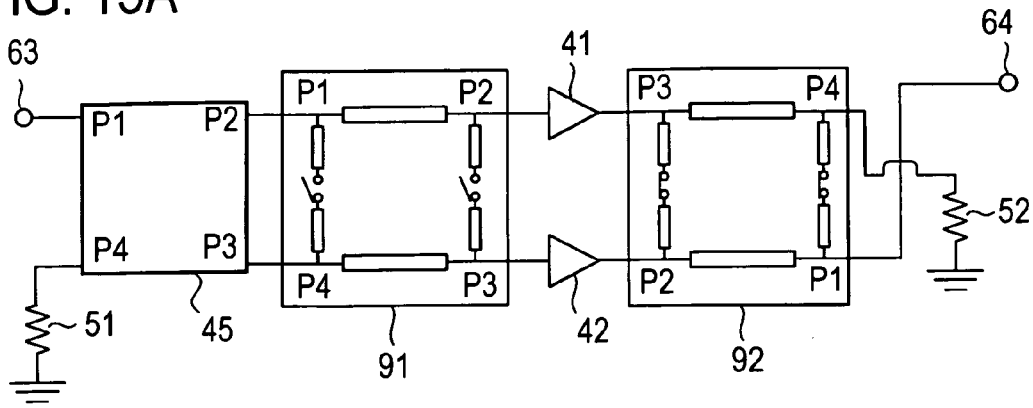
FIG. 15A is a diagram for explaining the one operation of another parallel operation amplifier using an embodiment of the quadrature hybrid circuit.
Figure 15B:
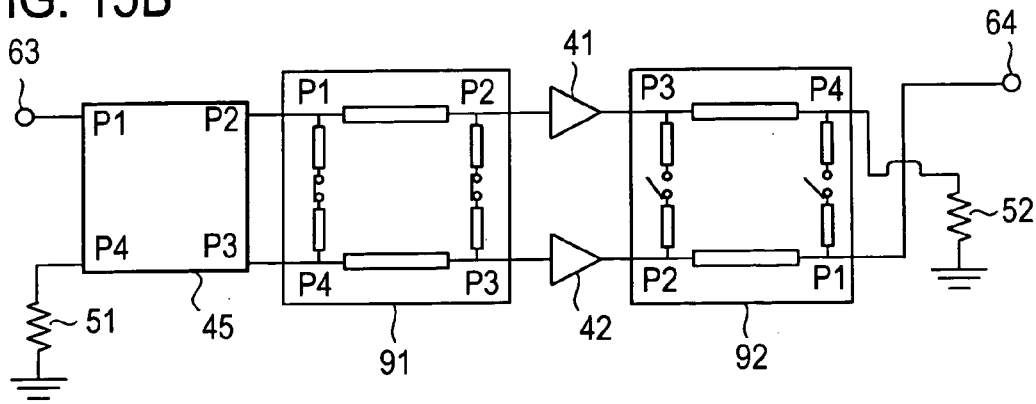
FIG. 15B is a diagram for explaining the other operation of the parallel operation amplifier of FIG. 15A.
Figure 27:
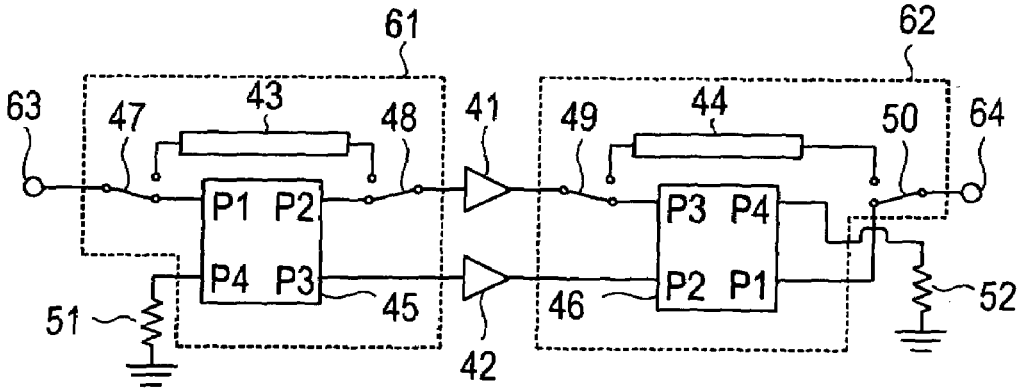
FIG. 27 PRIOR ART
FIG. 27 is a diagram showing a parallel operation power amplifier.
Figure 28:
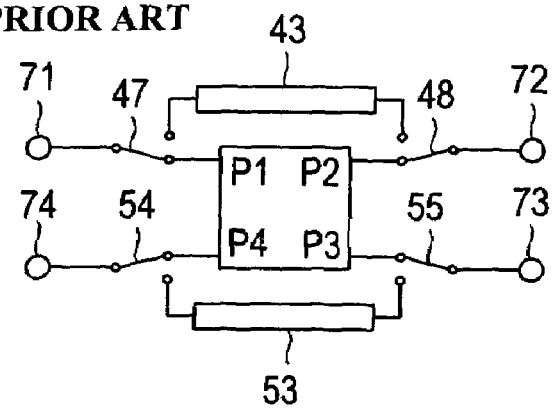
FIG. 28 PRIOR ART
FIG. 28 is a diagram showing a conventional quadrature hybrid circuit equipped with a function of ON/OFF control of power dividing or combining operation.
Figure 29:
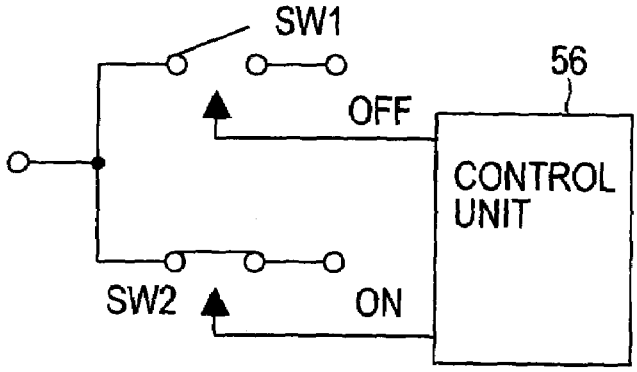
FIG. 29 PRIOR ART
FIG. 29 is a diagram showing the connection of SPST switches forming an SPDT switch.

FIGS. 15A and 15B illustrate another example of the quadrature hybrid circuit of the present invention as being applied to the parallel operation amplifier. In FIGS. 15A and 15B, the SPDT switch 65 in FIGS. 14A and 14B is not used, but instead the ports P2 and P3 of the conventional quadrature hybrid circuit 45 of FIG. 27 are connected to the ports P1 and P4 of the quadrature hybrid circuit 91, and a matching resistor 51 of the resistance $Z_0$ is connected between the port P4 of the quadrature hybrid circuit 45 and the ground. If the power amplifiers 41 and 42 are equivalent, 3 dB quadrature hybrid circuits are used as the quadrature hybrid circuits 45, 91 and 92. The quadrature hybrid circuits 45 and 91 may be exchanged in position.

By turning ON the power amplifiers 41 and 42, then controlling the SPST switches of the quadrature hybrid circuit 91 to inhibit it from functioning as a power divider, and controlling the SPST switches of the quadrature hybrid circuit 92 to permit the hybrid operation, the high-frequency signal of the frequency $f_0$ fed via the input terminal 63 is divided by the quadrature hybrid circuit 45 into two, and the two signals are allowed to pass intact through the quadrature hybrid circuit 91, then amplified by the power amplifiers 41 and 42, thereafter being combined by the quadrature hybrid circuit 92 and provided to the output terminal 64.

On the other hand, by turning OFF the power amplifier 41 and ON the power amplifier 42, then controlling the SPST switches of the quadrature hybrid circuits 91 and 92 to permit the former to perform the hybrid operation and to inhibit the later to function as a power combiner, the high-frequency signal of the frequency $f_0$ fed via the input terminal 63 is divided by the quadrature hybrid circuit 45 into two, the two signals are input to the ports P1 and P4 of the quadrature hybrid circuit 91, and due to the hybrid operation no signal is applied to the port P2 of the quadrature hybrid circuit 91, but instead they are combined and provided to the port P3. Accordingly, the high-frequency signal of the frequency $f_0$ input via the input terminal 63 is provided only to and amplifier by the power amplifier 42, and applied intact via the quadrature hybrid circuit 92 to the output terminal 64. In this case, the power supply to the power amplifier 41 is cut off, and hence its power consumption can be reduced. While in FIGS. 15A and 15B the quadrature hybrid circuit of the second embodiment is used, the hybrid circuits of the other embodiments can also be used.

Effect of the Invention

The quadrature hybrid circuit of the present invention is configured to control, in response to external control, the boundary condition on the plane of symmetry 5 by circuit elements at intermediate points of symmetry of the third and fourth two-port circuits. Accordingly, it is possible to control the quadrature hybrid circuit, with a simple circuit configuration, so that it performs the hybrid operation by which the high-frequency signal fed via the I/O port P1, for instance, is divided between the I/O ports P2 and P3, or it does not perform the hybrid operation and the high-frequency signal fed via the I/O port P1, for instance, is provided only to the I/O port P2.

According to the present invention, the circuit elements, which respond to an external signal to control the boundary condition, can be limited specifically to SPST switches. That is, the quadrature hybrid circuit capable of ON/OFF control of its power dividing or combining operation can be implemented with a simple configuration that merely involves the addition of two SPST switches to the conventional hybrid circuit; hence, the hybrid circuit of the present invention can be implemented in substantially the same size as the conventional hybrid circuit. Accordingly, parallel operation amplifiers equipped with the power control function, for instance, can be simplified in structure as depicted in FIGS. 14A, 14B and FIGS. 15A, 15B. As compared with the FIG. 27 example using conventional quadrature hybrid circuits, the parallel operation amplifiers of FIGS. 14 and 15 permit reduction of the required number of SPDT switches or SPST switches converted from the SPDT switches, and hence they implement low-loss circuit configuration. Hence, in addition to the effect of reduced power consumption by power control, the present invention implements high-efficiency operation as well which is based, in particular, on the low-loss circuit configuration at the output side of the amplifier.

Referring back to FIG. 13, according to the present invention, it is possible to implement a hybrid circuit that possesses, in addition to the function of effecting ON/OFF control of the power dividing or combining operation, the phase-shift control function during the OFF period of the power dividing or combining operation—this allows ease in constructing a radio circuit that needs the both functions.

What is claimed is:

1. A quadrature hybrid circuit in which, under the condition that first, second, third and fourth I/O ports are all matched, a high-frequency signal fed via said first I/O port is divided into two according to a predetermined degree of coupling and said divided signals are provided to said second and third I/O ports in phases displaced 90° apart, said quadrature hybrid circuit comprising:

circuit element means by which boundary condition on a plane of symmetry, with which side of the first and second I/O ports and side of the fourth and third I/O ports of the quadrature hybrid circuit are symmetrical to each other, is controlled in response to an external control signal so that said plane of symmetry become equivalent to a magnetic wall or electric wall;

a first two-port circuit connected between said first and second I/O ports;

a second two-port circuit connected between said fourth and third I/O ports;

a third two-port circuit connected between said first and fourth I/O ports; and a fourth two-port circuit connected between said second and third I/O ports wherein said circuit element means includes first and second circuit elements for controlling electromagnetic connections or coupling between said first and fourth I/O ports at an intermediate point of said third two-port circuit and between said second and third I/O ports at an intermediate point of said fourth two-port circuit, wherein said first and second circuit elements are first and second single-pole single-throw switches that divide said third and fourth two-port circuits into two at said intermediate point of symmetry, respectively, and are connected in series between said divided circuits of said third and fourth two-port circuits, respectively, and wherein third single-pole single-throw switches are each inserted between one end of said first and second single-pole single-throw switches and the ground.

2. The quadrature hybrid circuit of claim 1, wherein fourth single-pole single-throw switches are each inserted between the other end of each of said first and second single-pole single-throw switches and the ground.

3. The quadrature hybrid circuit of claim 2, wherein said first and second two-port circuits are formed by equivalent first and second transmission lines inserted between said first and second I/O ports and between said fourth and third I/O ports, respectively.

4. The quadrature hybrid circuit of claim 2, wherein said third and fourth two-port circuits are formed by equivalent first and second transmission lines inserted between said first and fourth I/O ports and between said second and third I/O ports, respectively.

5. The quadrature hybrid circuit of claim 2, wherein said first and second two-port circuits are formed by equivalent first and second lumped circuits inserted between said first and second I/O ports and between said fourth and third I/O ports, respectively.

6. The quadrature hybrid circuit of claim 2, wherein said third and fourth two-port circuits are formed by equivalent first and second lumped circuits inserted between said first and fourth I/O ports and between said second and third I/O ports, respectively.

7. The quadrature hybrid circuit of claim 1, wherein said first and second two-port circuits are formed by equivalent first and second lumped circuits inserted between said first and second I/O ports and between said fourth and third I/O ports, respectively.

8. The quadrature hybrid circuit of claim 7, wherein said first lumped circuit is a first π-circuit composed of a first inductor inserted between said first and second I/O ports and first and second capacitors inserted between one and the other ends of said first inductor and the ground, respectively, and said second lumped circuit is a second π-circuit composed of a second inductor inserted between said fourth and third I/O ports and third and fourth capacitors inserted between one and the other ends of said second inductor and the ground, respectively, said first and second π-circuits being equivalent to each other.

9. The quadrature hybrid circuit of claim 1, wherein said third and fourth two-port circuits are formed by equivalent first and second lumped circuits inserted between said first and fourth I/O ports and between said second and third I/O ports, respectively.

10. The quadrature hybrid circuit of claim 9, wherein said first lumped circuit is a first π-circuit composed of a first inductor inserted between said first and fourth I/O ports and first and second capacitors inserted between one and the other ends of said first inductor and the ground, respectively, and said second lumped circuit is a second π-circuit composed of a second inductor inserted between said second and third I/O ports and third and fourth capacitors inserted between one and the other ends of said second inductor and the ground, respectively, said first and second π-circuits being equivalent to each other.

11. The quadrature hybrid circuit of claim 9, wherein said third two-port circuit includes two equivalent first capacitors inserted in series between said first and fourth I/O ports, and said fourth two-port circuit includes two equivalent second capacitors, said first and second capacitors being equivalent to each other.

12. The quadrature hybrid circuit of claim 1, wherein said first and second two-port circuits are formed by equivalent first and second transmission lines inserted between said first and second I/O ports and between said fourth and third I/O ports, respectively.

13. The quadrature hybrid circuit of claim 1, wherein said third and fourth two-port circuits are formed by equivalent first and second transmission lines inserted between said first and fourth I/O ports and between said second and third I/O ports, respectively.

* * * * *